US012292225B2

(12) United States Patent
Byeon et al.

(10) Patent No.: US 12,292,225 B2
(45) Date of Patent: May 6, 2025

(54) REFRIGERATOR AND METHOD OF MANUFACTURING SAME

(71) Applicant: SAMSUNG ELECTRONICS CO., LTD., Suwon-si (KR)

(72) Inventors: Seungwon Byeon, Suwon-si (KR); Hyungbum Lee, Suwon-si (KR); Inyong Hwang, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 734 days.

(21) Appl. No.: 17/568,356

(22) Filed: Jan. 4, 2022

(65) Prior Publication Data

US 2022/0282907 A1 Sep. 8, 2022

Related U.S. Application Data

(63) Continuation of application No. PCT/KR2021/019883, filed on Dec. 24, 2021.

(30) Foreign Application Priority Data

Mar. 8, 2021 (KR) ..... 10-2021-0030442

(51) Int. Cl.
*F25D 21/00* (2006.01)
*F25D 21/04* (2006.01)
(Continued)

(52) U.S. Cl.
CPC ..... *F25D 21/04* (2013.01); *F25D 23/069* (2013.01); *F25D 25/02* (2013.01); *F25D 2400/06* (2013.01)

(58) Field of Classification Search
CPC ..... F25D 21/04; F25D 23/069; F25D 2400/06
See application file for complete search history.

(56) References Cited

U.S. PATENT DOCUMENTS 3,872,688 A 3/1975 Tillman
10,123,618 B2 11/2018 Lei et al.
(Continued)

FOREIGN PATENT DOCUMENTS

CN 207649198 U 7/2018
CN 108592501 A * 9/2018
(Continued)

OTHER PUBLICATIONS

International Search Report dated Apr. 18, 2022, in International Application No. PCT/KR2021/019883.
(Continued)

*Primary Examiner* — Brian M King
(74) *Attorney, Agent, or Firm* — STAAS & HALSEY LLP

(57) ABSTRACT

A refrigerator including an inner case forming a storage chamber, an intermediate partition partitioning the storage chamber in an upper-lower direction, and an evaporator seating part extending in a left-right direction, an evaporator cover to cover the evaporator seating part and formed with a cold air discharge port through which cold air from inside the evaporator seating part is dischargeable to the storage chamber, a first partition fixed to the intermediate partition and a bottom surface of the inner case and including a partition opening communicating with a space between the inner case and an outer case, a partition fixing opening formed in the inner case or the intermediate partition to allow an insulator to pass through the partition opening and the partition fixing opening, and a second partition couple-able to the first partition to divide the storage chamber in the left-right direction.

16 Claims, 25 Drawing Sheets

(51) Int. Cl.
*F25D 23/06* (2006.01)
*F25D 25/02* (2006.01)

(56) References Cited

U.S. PATENT DOCUMENTS

| | | | |
|---|---|---|---|
| 2014/0015394 | A1 | 1/2014 | Cha et al. |
| 2018/0224186 | A1* | 8/2018 | Besore ..... F25D 17/065 |

FOREIGN PATENT DOCUMENTS

| | | | | |
|---|---|---|---|---|
| CN | 208238372 | U | | 12/2018 |
| CN | 209214207 | U | | 8/2019 |
| DE | 10 2015 222 736 | A1 | | 5/2017 |
| JP | 2001-108359 | A | | 4/2001 |
| JP | 2007-40672 | A | | 2/2007 |
| JP | 3955700 | | | 5/2007 |
| JP | 4821531 | | | 11/2011 |
| JP | 2012-98010 | A | | 5/2012 |
| KR | 10-2017-0132635 | A | | 12/2017 |
| KR | 20170132635 | A | * | 12/2017 |
| KR | 10-2018-0039871 | A | | 4/2018 |
| KR | 10-1870899 | B1 | | 6/2018 |
| KR | 101870899 | | * | 6/2018 |
| KR | 10-2057987 | | | 12/2019 |

OTHER PUBLICATIONS

Office Action dated Feb. 12, 2024, issued in European Application No. 21 93 0491.

* cited by examiner

REFRIGERATOR AND METHOD OF MANUFACTURING SAME

CROSS-REFERENCE TO RELATED APPLICATION(S)

This application is a continuation application, under 35 U.S.C. § 111(a), of international application No. PCT/KR2021/019883, filed on Dec. 24, 2021, which claims priority to Korean Patent Application No. 10-2021-0030442, filed on Mar. 8, 2021, in the Korean Intellectual Property Office, the disclosure of which is incorporated by reference herein in its entirety.

BACKGROUND

Field

The disclosure relates to a refrigerator in which a storage chamber is divided into a plurality of storage chambers by a partition, and a method of manufacturing the same.

Description of Related At

In general, a refrigerator refers to an apparatus that includes a storage chamber and a cold air supply device for supplying cold air to the storage chamber to keep food fresh.

The temperature of the storage chamber is maintained at a temperature within a certain range required to keep food fresh.

The storage chamber of the refrigerator is provided to have a front side thereof open, and the open front side is normally closed by a door to maintain the temperature of the storage chamber.

The storage chamber is formed by an inner case, and an outer case forming an external appearance is coupled to an outer side of the inner case, and an insulator fills a space between the inner case and the outer case to prevent an outflow of cold air.

The storage chamber is partitioned by a partition fixed to the inner case forming the storage chamber, and when the insulator fills a space between the inner case and the outer case, the insulator also fills the partition.

In a region of the partition adjacent to an opening arranged on the front of the storage chamber, a hot pipe is buried to prevent dew condensation caused by a temperature difference between the outside of the refrigerator and the inside of the storage chamber.

In order to repair an evaporator disposed at an inside of the storage chamber, the partition may need to be disassembled and withdrawn from the storage chamber to the outside of the refrigerator, and in the process of disassembling the partition, the buried hot pipe is damaged.

SUMMARY

According to an aspect of the present disclosure, there is provided a refrigerator including: an inner case forming a storage chamber, an intermediate partition partitioning the storage chamber in an upper-lower direction, and an evaporator seating part extending in a left-right direction to corresponding to a width in the left-right direction of the storage chamber; an outer case coupled to an outer side of the inner case to form an external appearance of the refrigerator; an evaporator cover configured to cover the evaporator seating part and formed with a cold air discharge port through which cold air from inside the evaporator seating part is dischargeable to the storage chamber; a first partition fixed to the intermediate partition and a bottom surface of the inner case, the first partition including a partition opening that communicates with a space between the inner case and the outer case; a partition fixing opening formed in the inner case or the intermediate partition, the partition fixing opening provided at a position corresponding to the partition opening to allow an insulator to pass through the partition opening and the partition fixing opening; and a second partition coupleable to the first partition so that, while coupled to the first partition, the second partition is inside the storage chamber supported by at least a portion of the inner case or the evaporator cover and arranged behind the first partition to form a partitioning part together with the first partition to thereby divide the storage chamber in the left-right direction, and being decoupleable from the first partition to thereby be removable from the storage compartment.

The refrigerator may further include a condenser, and a hot pipe extending from the condenser, wherein the hot pipe may be buried along a circumference of an opening of the storage chamber and may have a portion extending in parallel with the first partition.

The refrigerator may further include a partition cover extending in parallel with the first partition and coupled to the first partition while covering the portion of the hot pipe extending in parallel with the first partition so that the portion of the hot pipe extending in parallel with the first partition is not seen at a front of the refrigerator.

The first partition may include: a left first partition; a right first partition coupled to a right side of the left first partition; and a hot pipe seating part seating the hot pipe in an area between the left first partition and the right first partition and spacing the left first partition from the right first partition, and the partition cover may be coupled to a front surface of the hot pipe seating part.

The first partition may include a first coupling part protruding from a surface of the first partition and having a first fastening hole, the second partition may include a second coupling part protruding from a surface of the second partition and having a second fastening hole, and the refrigerator may further include a fastening member configured to simultaneously pass through the first fastening hole and the second fastening hole to couple the first partition and the second partition to each other.

The first coupling part may further include support parts configured to support ends of the second coupling part in an upper-lower direction.

The first coupling part or the support parts may be formed on one of the right first partition and the left first partition.

The inner case may include a rear wall forming a rear surface of the storage chamber while facing an opening of the storage chamber, the evaporator seating part may be provided by a portion of the rear wall being recessed rearward, and the evaporator seating part may include an evaporator seating opening that is opened to face the opening.

The evaporator cover may have a shape corresponding to a shape of the evaporator seating opening.

The second partition may include a second partition support part that protrudes toward the evaporator cover while the second partition is coupled to the first partition, the evaporator cover may include a second partition seating part formed at a position corresponding to the second partition support part, and the second partition seating part may be provided to keep the second partition in position while surrounding at least a portion of the second partition support part.

The second partition may include a left partition, and a right partition coupled to a right side of the left partition; and a space formed between the left partition and the right partition may be provided as an empty space.

The partitioning part may partition the storage chamber into a left storage chamber and a right storage chamber, and the partitioning part may be provided such that cold air flows from the left storage chamber to the right storage chamber or from the right storage chamber to the left storage chamber.

A filling part may be provided between the inner case and the outer case, and the partition opening may include a first partition opening and a second partition opening formed at respective ends of the first partition such that a hollow part formed inside the first partition communicates with the filling part, the partition fixing opening may include a first partition fixing opening provided at a position corresponding to the first partition opening and a second partition fixing opening provided at a position corresponding to the second partition opening, and the insulator may fill the filling part and the hollow part by passing through the first partition opening and the first partition fixing opening or passing through the second partition opening and the second partition fixing opening.

The first partition may further include a communication part connecting the partition opening to the partition fixing opening, the communication part protruding from the first partition while surrounding the partition opening and having a side surface supported by an inner surface of the partition fixing opening.

The communication part may include a first communication part corresponding to the first partition opening and a second communication part corresponding to the second partition opening, and the first communication part may include a first fixing hook extending from one end of the first communication part to enable elastic deformation, the first fixing hook supported on a surface of the inner case facing the filling part and located at a circumference of the first partition fixing opening, and the second communication part may include a second fixing hook extending from one end of the second communication part, the second fixing hook supported on a surface of the inner case facing the filling part and located at a circumference of the second partition fixing opening.

The intermediate partition may be formed as a portion of the inner case that is bent.

DESCRIPTION OF THE DRAWINGS

The above and other aspects, features, and advantages of certain embodiments of the present disclosure will be more apparent from the following description taken in conjunction with the accompanying drawings, in which.

DETAILED DESCRIPTION

Figure 1:
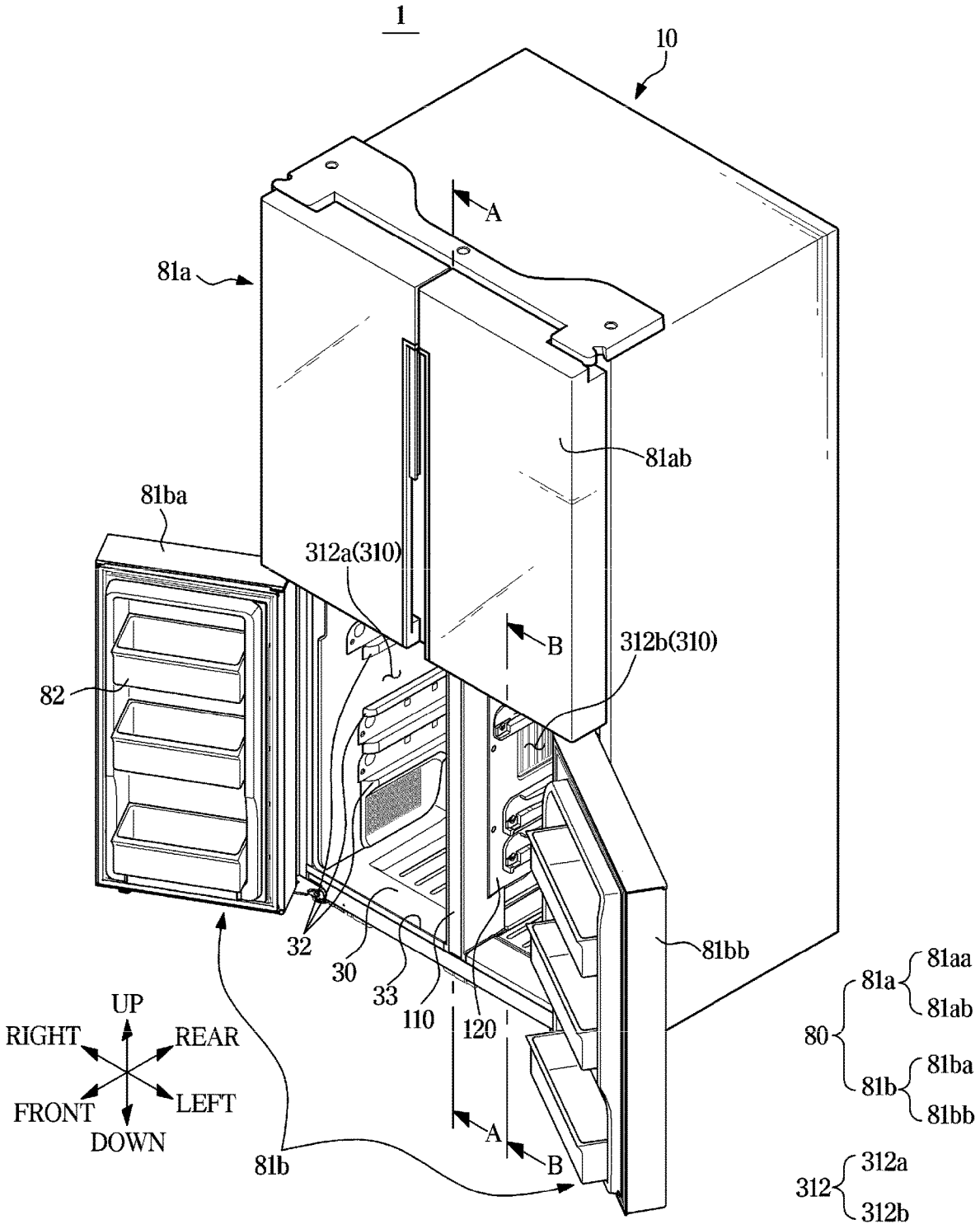
FIG. 1 is a perspective view illustrating a refrigerator according to an embodiment of the disclosure.

The embodiments set forth herein and illustrated in the configuration of the disclosure are only example embodiments and are not representative of the full technical spirit of the disclosure, so it should be understood that they may be replaced with various equivalents and modifications at the time of the disclosure.

Throughout the drawings, like reference numerals refer to like parts or components.

The terminology used herein is for the purpose of describing particular embodiments only and is not intended to limit the disclosure. It is to be understood that the singular forms "a," "an," and "the" include plural references unless the context clearly dictates otherwise. It will be further understood that the terms "include", "comprise" and/or "have" when used in this specification, specify the presence of stated features, integers, steps, operations, elements, and/or components, but do not preclude the presence or addition of one or more other features, integers, steps, operations, elements, components, and/or groups thereof.

The terms including ordinal numbers like "first" and "second" may be used to explain various components, but the components are not limited by the terms. The terms are only for the purpose of distinguishing a component from another. Thus, a first element, component, region, layer or section discussed below could be termed a second element, component, region, layer or section without departing from the teachings of the disclosure. Descriptions shall be understood as to include any and all combinations of one or more of the associated listed items when the items are described by using the conjunctive term "— and/or —," or the like.

The terms "upper side", "lower side", "upper end", "lower end", "upper surface", and "lower surface" as herein used are defined with respect to FIG. 1, but the terms may not restrict the shape and position of the respective components.

An aspect of the disclosure provides a refrigerator capable of facilitating repair of an evaporator without damaging a hot pipe during a disassembly process of a partition.

Another aspect of the disclosure provides a method of manufacturing a refrigerator capable of facilitating repair of an evaporator without damaging a hot pipe during a disassembly process of a partition, and omitting a process of separately filling the partition with an insulator.

Hereinafter, an embodiment according to the disclosure will be described in detail with reference to the accompanying drawings.

Figure 2:
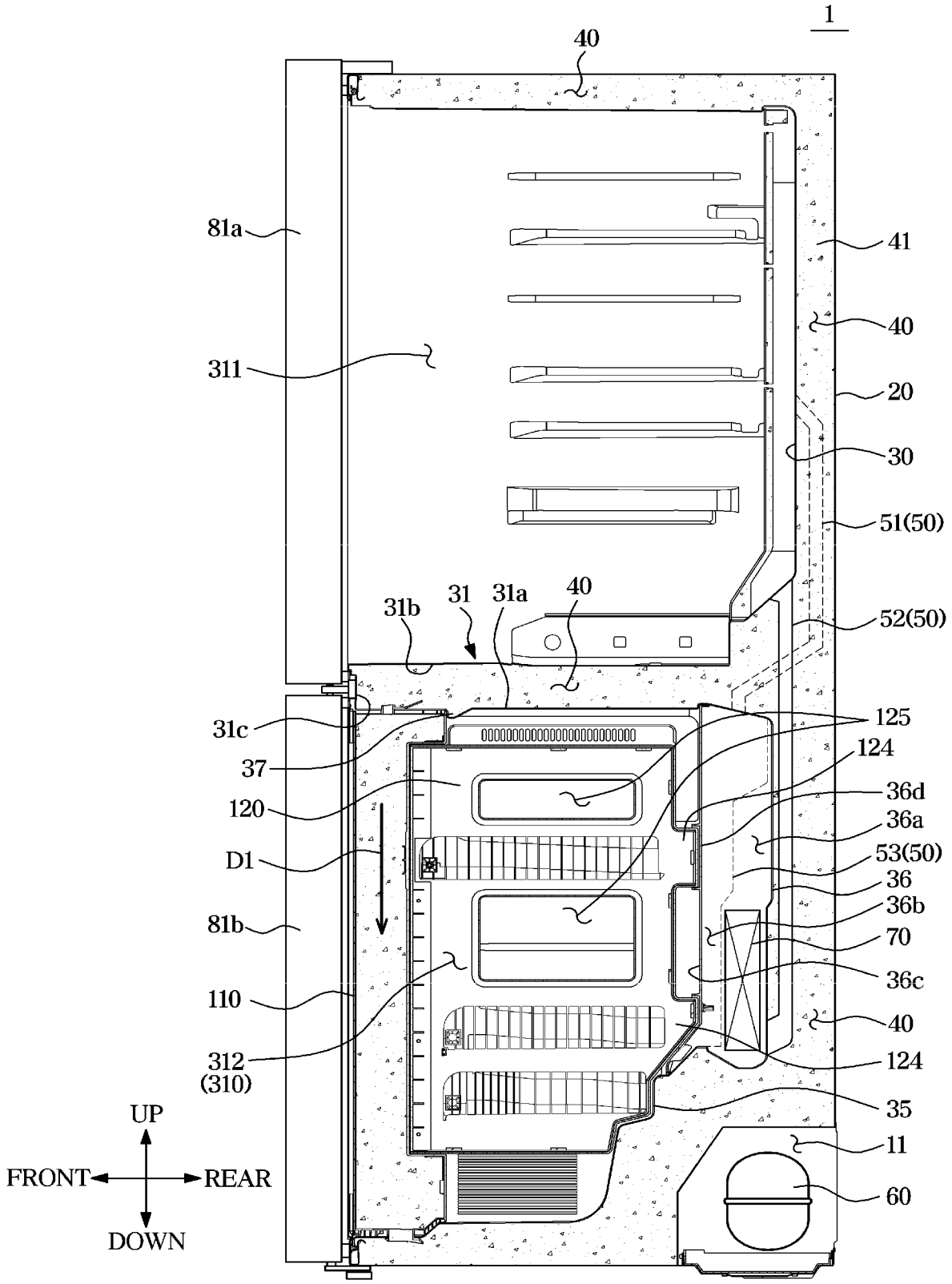
FIG. 2 is a cross-sectional view taken along line A-A of FIG. 1.
Figure 3:
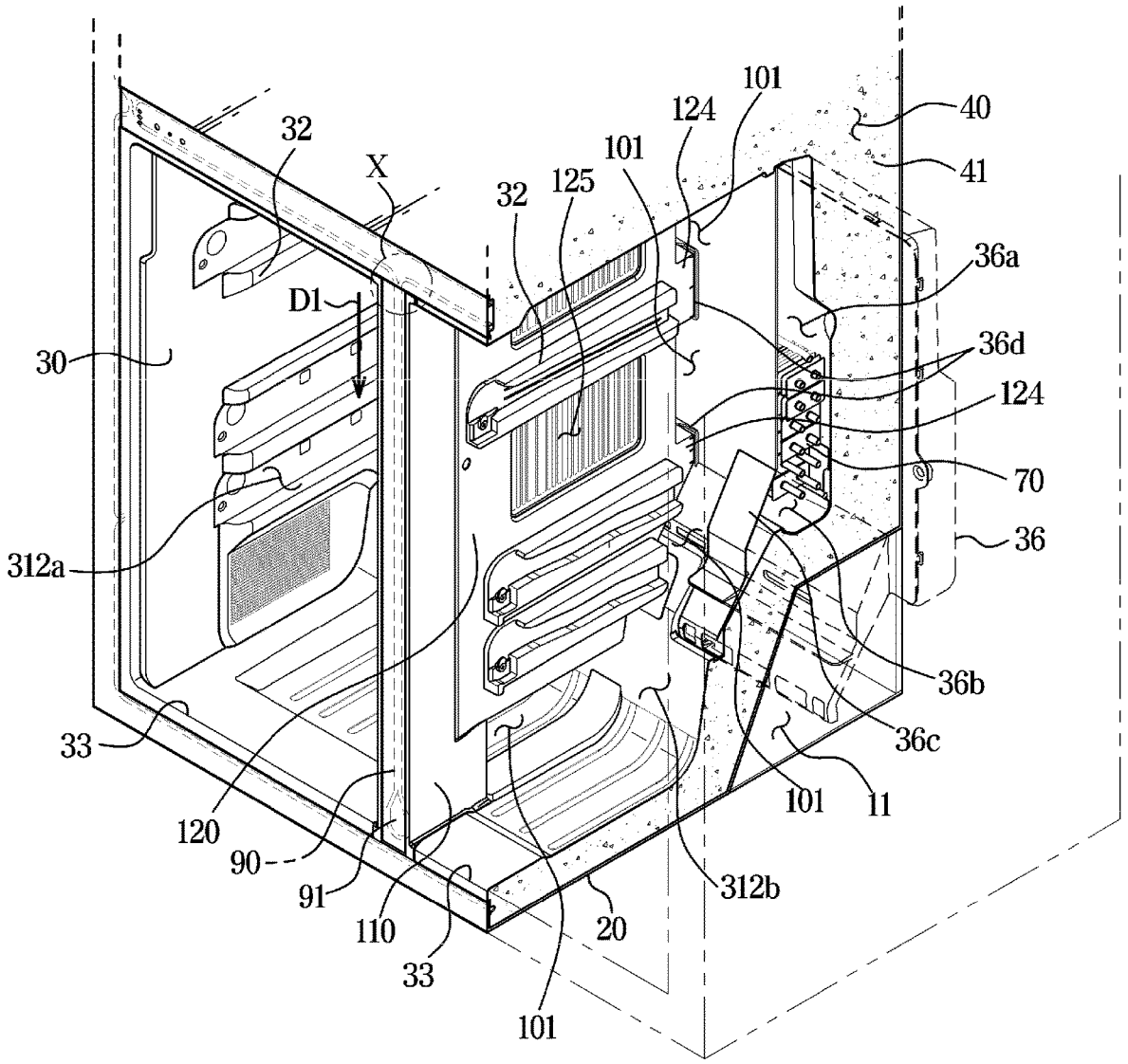
FIG. 3 is a partial perspective view illustrating a cross-section taken along line B-B of FIG. 1.
Figure 4:
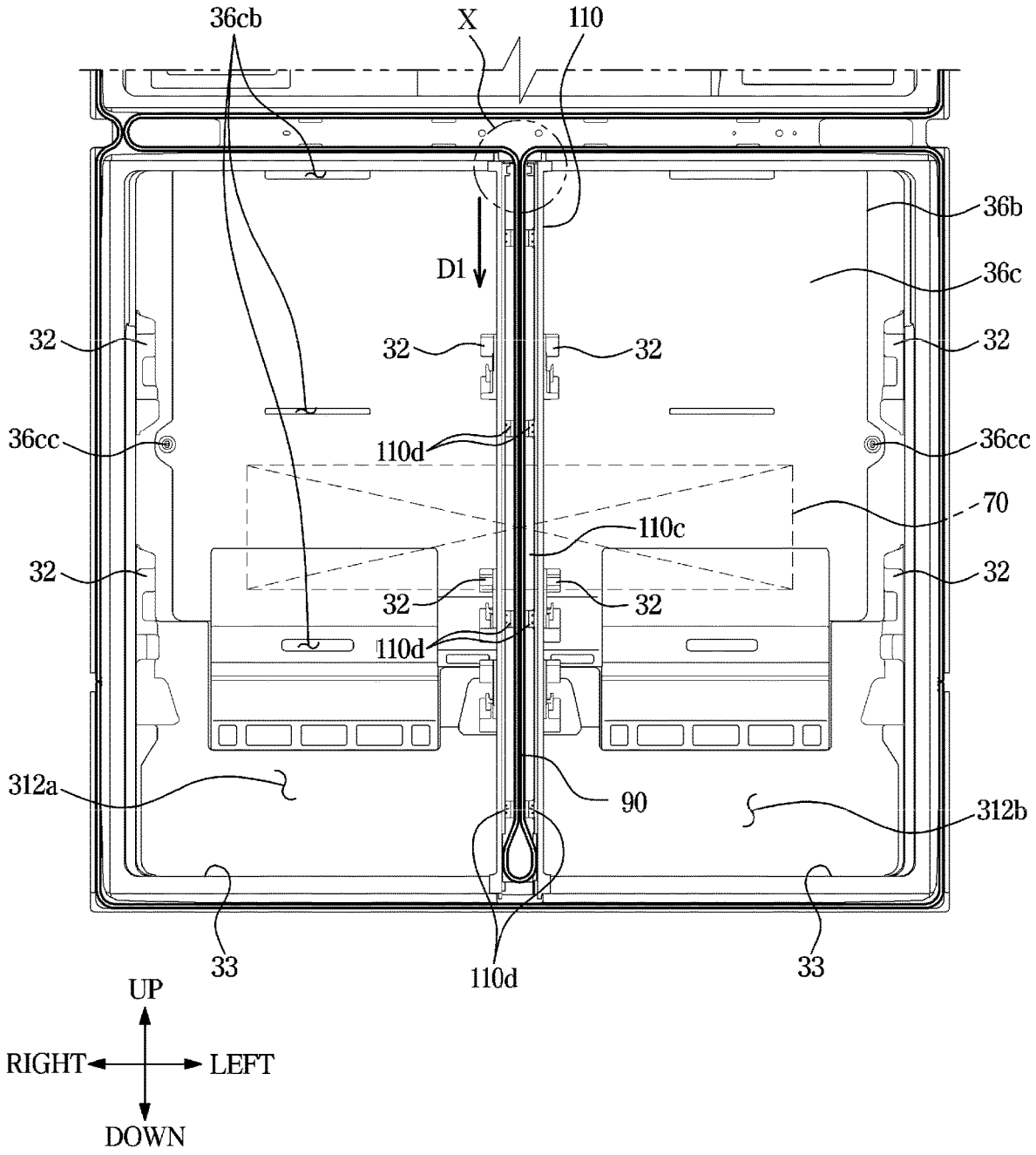
FIG. 4 is a front view illustrating a lower storage chamber of the refrigerator in which a lower door and a hot pipe cover are removed according to the embodiment of the disclosure.

FIG. 1 is a perspective view illustrating a refrigerator according to an embodiment of the disclosure. FIG. 2 is a cross-sectional view taken along line A-A of FIG. 1. FIG. 3 is a partial perspective view illustrating a cross-section taken along line B-B of FIG. 1. FIG. 4 is a front view illustrating a lower storage chamber of the refrigerator in which a lower door and a hot pipe cover are removed according to the embodiment of the disclosure.

Referring to FIGS. 1 to 2, a refrigerator 1 includes a main body 10, a storage chamber 310 provided to have a front thereof open inside the main body 10, a door 80 rotatably coupled to the main body 10 to open and close the open front side of the storage chamber 310, and a first partition 110 and a second partition 120 coupled to the inside of the storage chamber 310 to divide the storage chamber 310 into a plurality of storage chambers.

The main body 10 includes an inner case 30 forming the storage chamber 310 and an outer case 20 forming the external appearance, and includes a cold air supply device (not shown) for supplying cold air to the storage chamber 310.

The inner case 30 may form the storage chamber 310 therein. The outer case 20 is coupled to the outside of the inner case 30 to form the external appearance. The outer case 20 may be spaced apart from the inner case 30 at a predetermined interval and coupled to the inner case 30. Between the inner case 30 and the outer case 20, a filling part 40 in which an insulator 41 is filled may be provided.

The cold air supply device may include a compressor 60, a condenser (not shown), an expansion valve (not shown), an evaporator 70, a blowing fan (not shown), a cold air duct 50, and the like.

The main body 10 is provided with a machine room 11 at a rear lower portion thereof, in which the compressor 60 for compressing a refrigerant and a condenser (not shown) for condensing the compressed refrigerant are installed.

The storage chamber 310 may be divided into a plurality of storage chambers 310 by partitions 110 and 120, and may include a plurality of shelves (not shown) and storage containers (not shown) to store food and the like therein. A plurality of rails 32 may be provided on an inner sidewall of the inner case 30 forming the storage chamber 310 such that the plurality of shelves (not shown) or the storage container (not shown) may be slidably coupled.

The inner case 30 may have the storage chamber 310 formed therein. The inner case 30 may include an opening 33 formed at a front side of the storage chamber 310. A hot pipe 90 to be described below may be disposed on an edge portion of the opening 33.

The storage chamber 310 may include an upper storage chamber 311 and a lower storage chamber 312. The refrigerator 1 may include an intermediate partition 31 for dividing the upper storage chamber 311 from the lower storage chamber 312.

Referring to FIG. 2, the intermediate partition 31 may be formed by the inner case 30. The refrigerator 1 may have a bent portion 31*c* provided by bending the inner case 30 into a U-shape based on a side sectional view of the refrigerator 1 to form the intermediate partition 31. The inner case 30 may be bent such that a surface 31*a* of the inner case 30 faces another surface 31*b* of the inner case 30. The surface 31*a* of the inner case 30 and the other surface 31*b* of the inner case 30 may be spaced apart from each other to form the filling part 40 in which the insulator 41 is filled. That is, the filling part 40 may be provided not only between the inner case 30 and the outer case 20, but between some regions of the inner case 30 that are provided to face each other by a bent of the inner case 30.

With such a configuration, a production process of forming the external appearance of the refrigerator 1 may be simplified by coupling the outer case 20 to the outer side of the inner case 30, in which the upper storage chamber 311 and the lower storage chamber 312 are formed, rather than separately manufacturing and coupling the upper storage chamber 311 and the lower storage chamber 312. However, the structure of the intermediate partition 31 is not limited thereto, and the intermediate partition 31 may be separately manufactured from the inner case and then coupled to the inner case to divide the storage chamber 310 in an upper-lower direction.

The refrigerator 1 may include partitioning parts which may include, for example, first and second partitions 110 and 120, for dividing the storage chamber 310 into a left storage chamber 312*b* and a right storage chamber 312*a*. The lower storage chamber 312 may be divided into a left storage chamber 312*b* and a right storage chamber 312*a* by the first partition 110 and the second partition 120 to be described below. Hereinafter, the term "storage chamber" may be used as a term referring to the lower storage chamber 312.

The open front of the storage chamber 310 may be opened and closed by the door 80. In other words, the opening 33 of the inner case 30 may be opened and closed by the door 80.

The door 80 may include an upper door 81*a* that opens and closes the upper storage chamber 311 and a lower door 81*b* that opens and closes the lower storage chamber 312, and formed on a rear surface thereof with a plurality of guards 82 to accommodate food.

The upper door 81*a* may include an upper right door 81*aa* and an upper left door 81*ab*.

The lower door 81*b* may include a lower right door 81*ba* and a lower left door 81*bb*. The lower door 81*b* may open and close the lower storage chamber 312. Specifically, the lower right door 81*ba* may open and close the right storage chamber 312*a* of the lower storage chamber 312, and the lower left door 81*bb* may open and close the left storage chamber 312*b* of the lower storage chamber 312. In a state in which the lower right door 81*ba* and the lower left door 81*bb* close the storage chamber 310, specifically, the lower storage chamber 312, the first partition 110 to be described below may be disposed at a position corresponding to an area between the lower right door 81*ba* and the lower left door 81*bb*. The first partition 110 may be disposed approximately at a central portion of the opening 33. The structure and arrangement of the first partition 110 will be described in detail below.

The inner case 30 may include a rear wall 36 forming a rear surface of the storage chamber 310 while facing the opening 33. The rear wall 36 may include an evaporator seating part 36*a* formed as a portion of the rear wall 36 being recessed toward the rear side of the refrigerator 1. The evaporator 70 may be seated on the evaporator seating part 36*a*.

The evaporator seating part 36*a* may include an evaporator seating opening 36*b* that is opened toward the opening 33 to face the opening 33. The evaporator seating part 36*a* may include an inner surface having a substantially rectangular parallelepiped shape, and have a surface facing the opening 33 that is open.

The width in the left-right direction of the evaporator seating part 36*a* may be provided to correspond to the width in the left-right direction of the storage chamber 310. The evaporator 70 disposed on the evaporator seating part 36*a* may be provided as a single evaporator formed to extend in the left-right direction to correspond to the width in the left-right direction of the evaporator seating part 36*a*. In other words, the evaporator 70 may not be provided as a plurality of evaporators corresponding to each of the lower left storage chamber 312 and the lower right storage chamber 312, but may be provided as a single evaporator capable of simultaneously supplying cold air to the lower left storage chamber 312 and the lower right storage chamber 312.

Referring to FIG. 4, the refrigerator 1 may further include an evaporator cover 36*c* that is provided in a shape corresponding to the evaporator seating opening 36*b* and cover the evaporator seating part 36*a*. The evaporator cover 36*c* may be provided in a substantially rectangular plate shape to correspond to the shape of the evaporator seating opening 36*b*.

The evaporator cover 36*c* may include an evaporator cover fastening parts 36*ca* formed on the left and right edges thereof so as to be fixed to the inner case 30 while corresponding to the evaporator seating opening 36*b*. The inner case 30 may be formed with fastening holes (not shown) at positions corresponding to the evaporator cover fastening parts 36*ca*, and the fastening hole (not shown) of the inner case 30 and the evaporator cover fastening part 36*ca* are coupled to each other through a separate fastening member (not shown) such that the evaporator cover 36*c* may be fixed to the inner case 30.

Referring to FIG. 4, one unit of the evaporator cover fastening part 36*ca* is provided at each of the left and right sides of the evaporator cover 36*c*, but the number of the evaporator cover fastening parts 36*ca* is not limited thereto.

The evaporator cover 36*c* may include a cold air discharge port 36*cb* for discharging cold air inside the evaporator seating part 36*a* into the storage chamber 310. The cold air discharge port 36*cb* may be provided such that the evaporator seating part 36*a* and the storage chamber 310 communicate with each other. The cold air discharge port 36*cb* may be provided in plural, and may be formed on the evaporator cover 36*c* such that cold air is supplied to each of the left storage chamber 312*b* or the right storage chamber 312*a*. Referring to FIG. 4, the cold air discharge ports 36*cb* may be formed side by side on the evaporator cover 36*c* to correspond to the left storage chamber 312*b* or the right storage chamber 312*a*. The plurality of cold air discharge ports 36*cb* may be spaced apart from each other in the upper-lower direction by a predetermined interval therebetween.

Referring to FIG. 4, the total of three units of the cold air discharge ports 36*cb* may be provided in the upper-lower direction to correspond to the left storage chamber 312*b*, and the total of three units of the cold air discharge ports 36*cb* may be provided in the upper-lower direction to correspond to the right storage chamber 312*a*. However, the number of the cold air discharge ports 36*cb* is not limited thereto.

The cold air duct 50 may include a supply duct 51 and a recovery duct 52. The supply duct 51 or the recovery duct 52 may be provided to communicate the evaporator seating part 36*a* with the upper storage chamber 311. Therefore, only with a single evaporator 70 disposed on the evaporator seating part 36*a* formed on the lower storage chamber 312 without having an evaporator corresponding to the upper storage chamber 311, cold air is supplied not only to the lower storage chamber 312 but also to the upper storage chamber 311 through the supply duct 51. In addition, air may be recovered from the upper storage chamber 311 through the recovery duct 52, and then cooled through the evaporator 70.

However, the disclosure is not limited thereto, and the evaporator seating part 36*a* may be formed also in the upper storage chamber 311 similar to the lower storage chamber 312, and the evaporator may be disposed on the evaporator seating part 36*a* such that the upper storage chamber 311 may also be directly supplied with cold air without the supply duct 51 or the recovery duct 52.

The cold air duct 50 may further include a guide duct 53. The guide duct 53 may be disposed behind the evaporator cover 36*c* and may be provided to communicate the cold air discharge port 36*cb* with the evaporator seating part 36*a*. A detailed specific structure of the guide duct 53 will be described below.

Referring to FIGS. 2 to 3, after the evaporator 70 is disposed on the evaporator seating part 36*a*, the evaporator cover 36*c* may be coupled to the inner case 30 to close the evaporator seating opening 36*b*. The evaporator cover 36*c* is formed with a cover fixing part 36*cc* on the edge thereof, and as a fastening member (C, see FIG. 21) passes through the cover fixing part 36*cc* to be fixed to the inner case, so that the evaporator cover 36*c* is fixed to the inner case 30.

The refrigerator 1 may be provided such that after the second partition 120 is coupled to the first partition 110, the second partition 120 presses the center of the evaporator cover 36*c* toward the rear wall 36. In order for the second partition 120 to stably press the center of the evaporator cover 36*c* toward the rear wall 36, the second partition 120 may include a second partition support part 124 that is formed to protrude rearward toward the evaporator cover 36*c* in a state in which the second partition 120 is coupled to the first partition 110. The evaporator cover 36*c* may further include a second partition seating part 36*d* at a position corresponding to the second partition support part 124. Details of the second partition support part 124 and the second partition seating part 36*d* will be described below.

A refrigerant pipe connecting the condenser (not shown) to the expansion device (not shown) may be provided with a cluster pipe (not shown) bending a number of times on the upper surface and both sidewalls of the main body 10 and extending, and a hot pipe 90 installed along a circumference of the opening 33.

The hot pipe 90 extending from the condenser (not shown) may be buried along the circumference of the opening 33 of the main body 10, and may prevent dew formation on the front side of the main body 10 caused by a temperature difference between the inside and outside through heat dissipation of a high temperature refrigerant flowing inside the hot pipe 90 while increasing the amount of heat dissipation on the high-pressure side.

On the other hand, in general, a hot pipe is connected using a single refrigerant pipe, and the hot pipe has an inlet and an outlet respectively connected to an outlet of a high-pressure side refrigerant pipe and an inlet of a valve that controls circulation of a refrigerant into a refrigerating chamber evaporator or a freezing chamber evaporator.

The hot pipe 90 may be disposed along the first partition 110 disposed approximately at the center of the opening 33. Accordingly, in a state in which the lower right door 81*ba* and the lower left door 81*bb* close the storage chamber 310, specifically, the lower storage chamber 312, dew condensation that may occur in an area between the lower right door 81*ba* and the lower left door 81*bb* may be prevented.

However, in order to repair the evaporator 70 disposed behind the storage chamber 310, there is a need to remove the evaporator cover 36*c*, and disassemble the partition disposed on a path of the evaporator cover 36*c* being separated and pressing the evaporator cover 36*c* rearward of the storage chamber 310.

Since the hot pipe 90 is connected using a single refrigerant pipe, as shown in FIG. 4, a portion X extending from the edge of the inner case 30 along a circumference of the opening 33 to the first partition 110 or a portion X extending from the first partition 110 to the edge of the inner case 30 along a circumference of the opening 33 may be damaged in the process of disassembling the partitions 110 and 120. Accordingly, there is a need for a structure that allows only the second partition 120 to be effectively disassembled while the first partition 110 is fixed to the inner case 30 when the partition dividing the storage chamber 310 into the left storage chamber 312*b* and the right storage chamber 312*a* is formed as the first partition 110 and the second partition 120.

Figure 5:
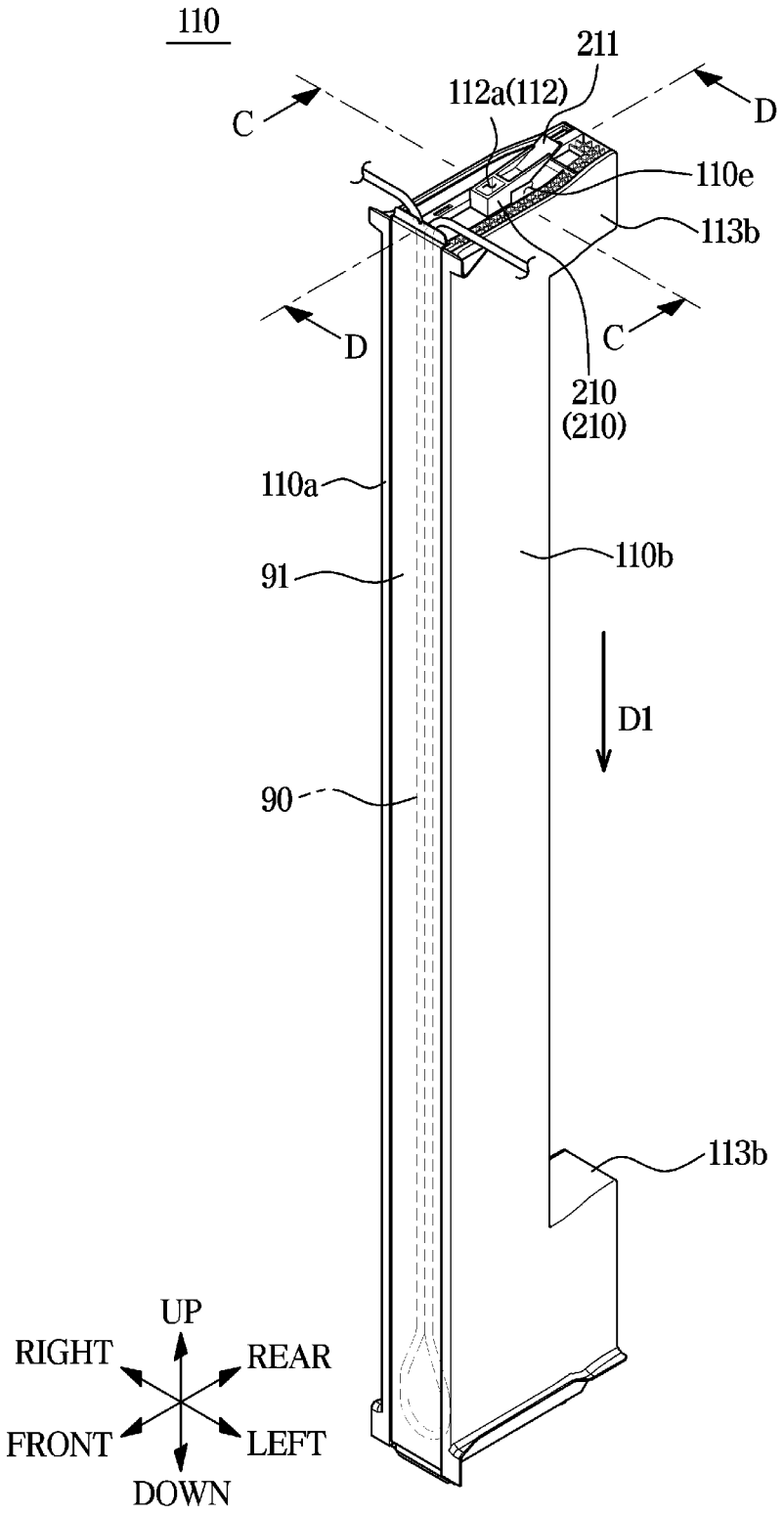
FIG. 5 is a perspective view illustrating a first partition of the refrigerator according to the embodiment of the disclosure.
Figure 6:
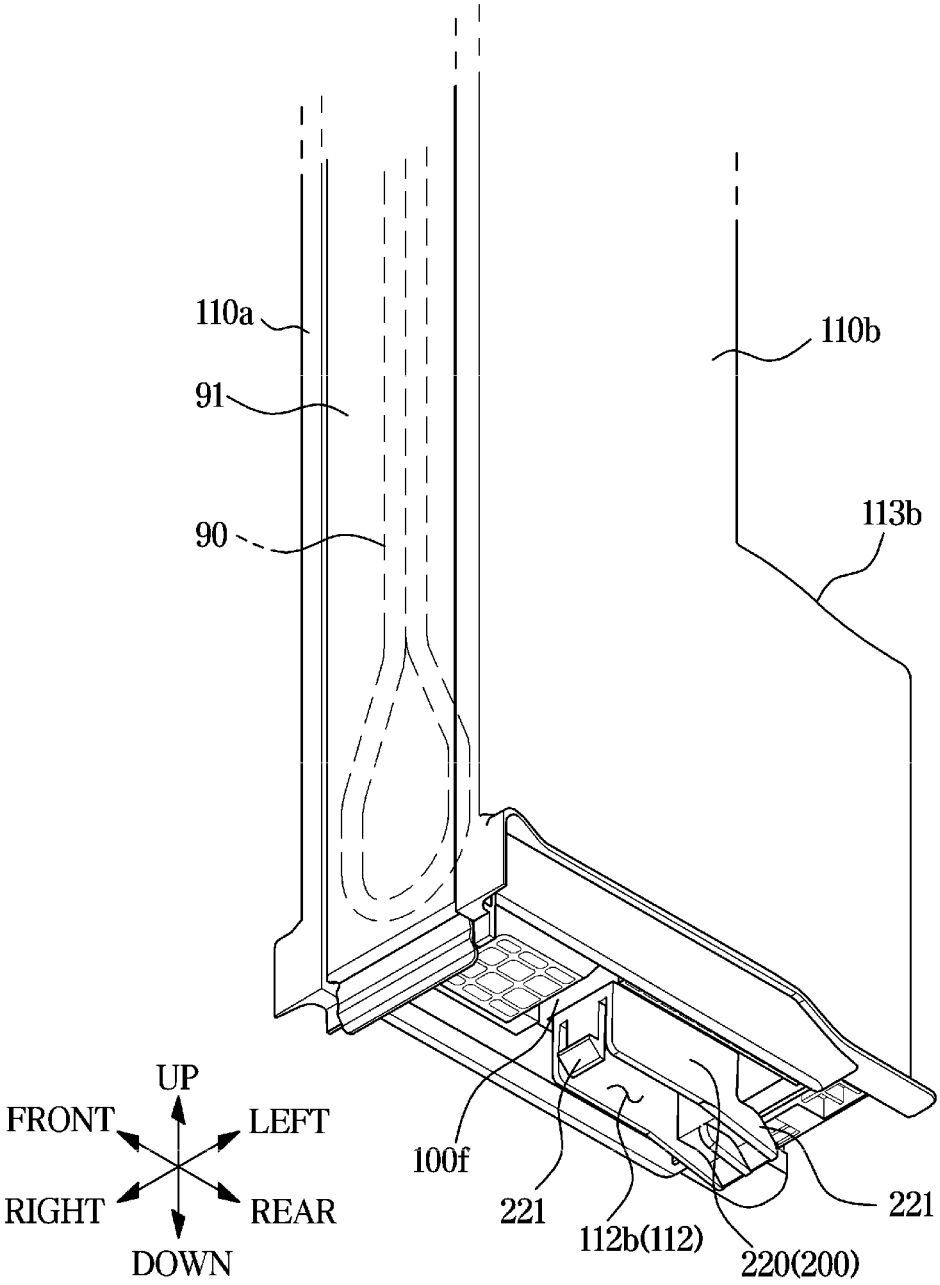
FIG. 6 is a perspective view illustrating a lower portion of the first partition of the refrigerator according to the embodiment of the disclosure.
Figure 7:
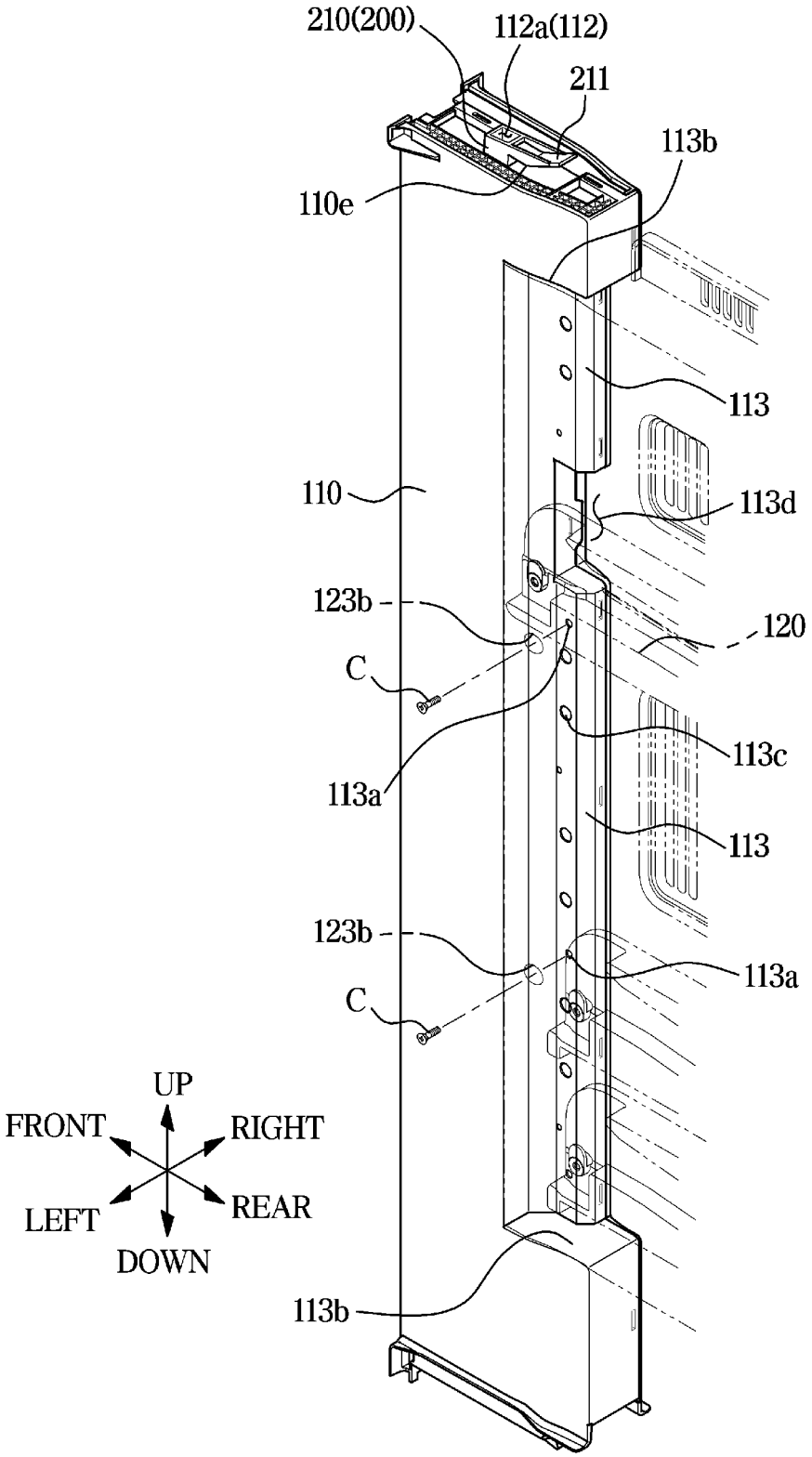
FIG. 7 is a perspective view illustrating the first partition of the refrigerator according to the embodiment of the disclosure, when viewed in a different direction.
Figure 8:
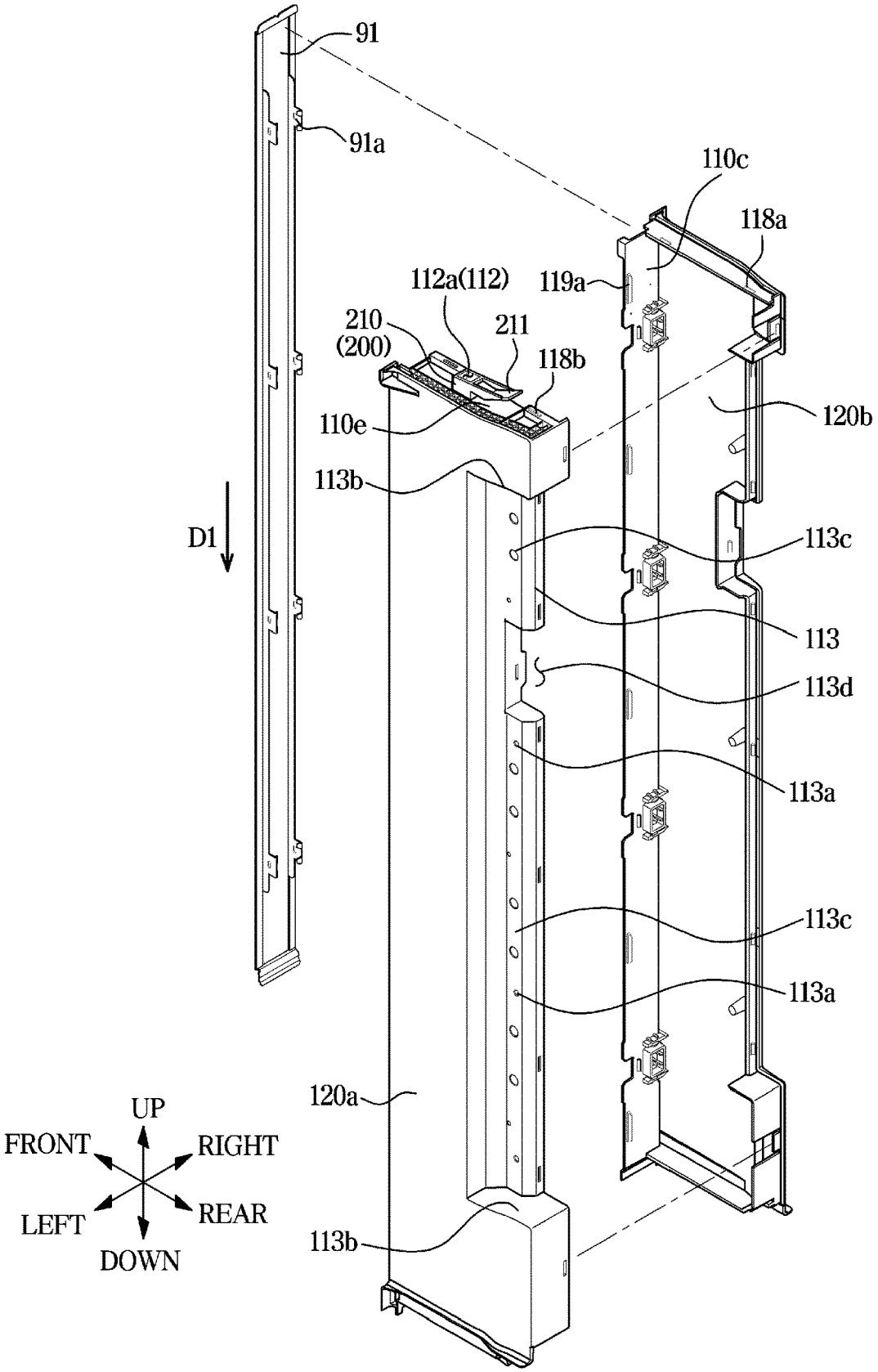
FIG. 8 is an exploded perspective view illustrating the first partition of the refrigerator according to the embodiment of the disclosure.
Figure 9:
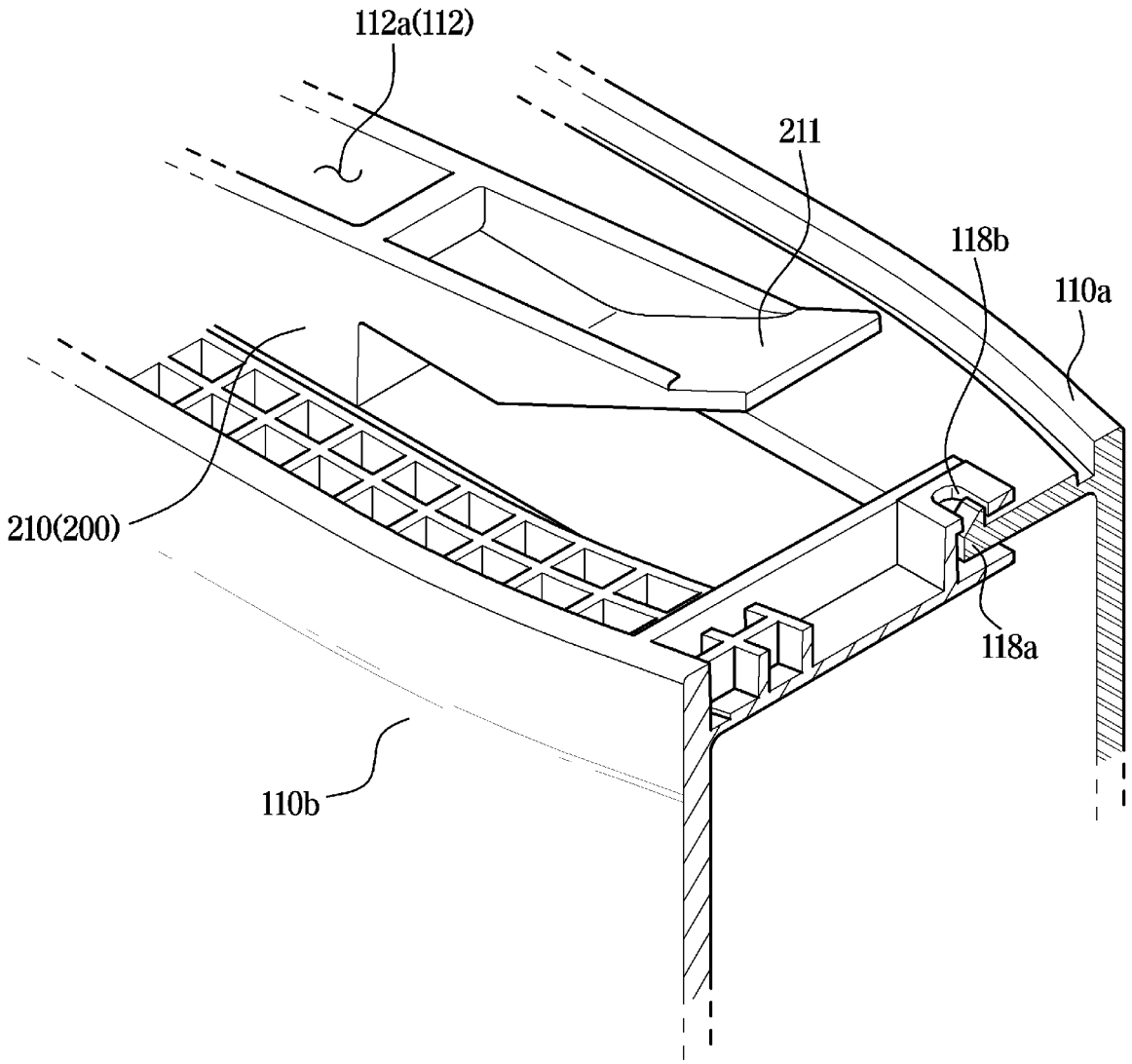
FIG. 9 is a cross-sectional view illustrating a first hook and a first fastening groove of the refrigerator according to the embodiment of the disclosure.
Figure 10:
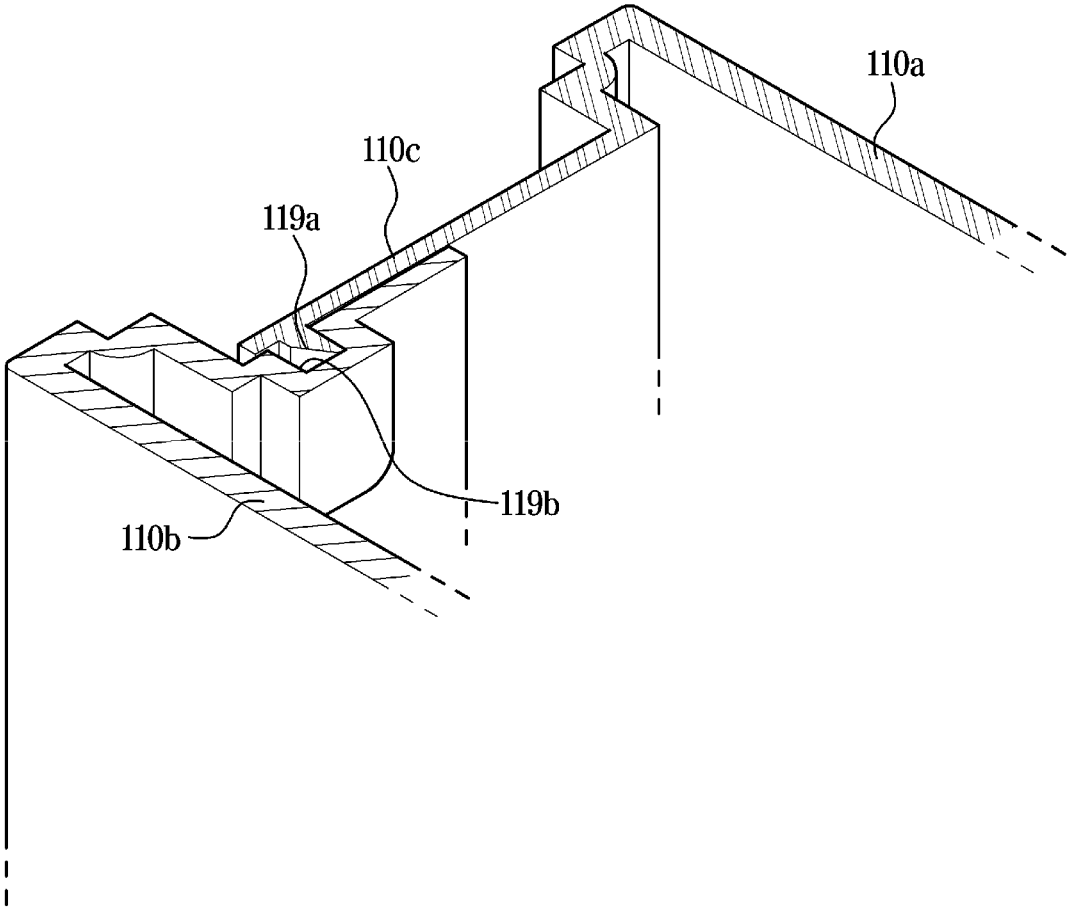
FIG. 10 is a cross-sectional view illustrating a first sub-hook and a second sub-fastening groove of the refrigerator according to the embodiment of the disclosure.
Figure 11:
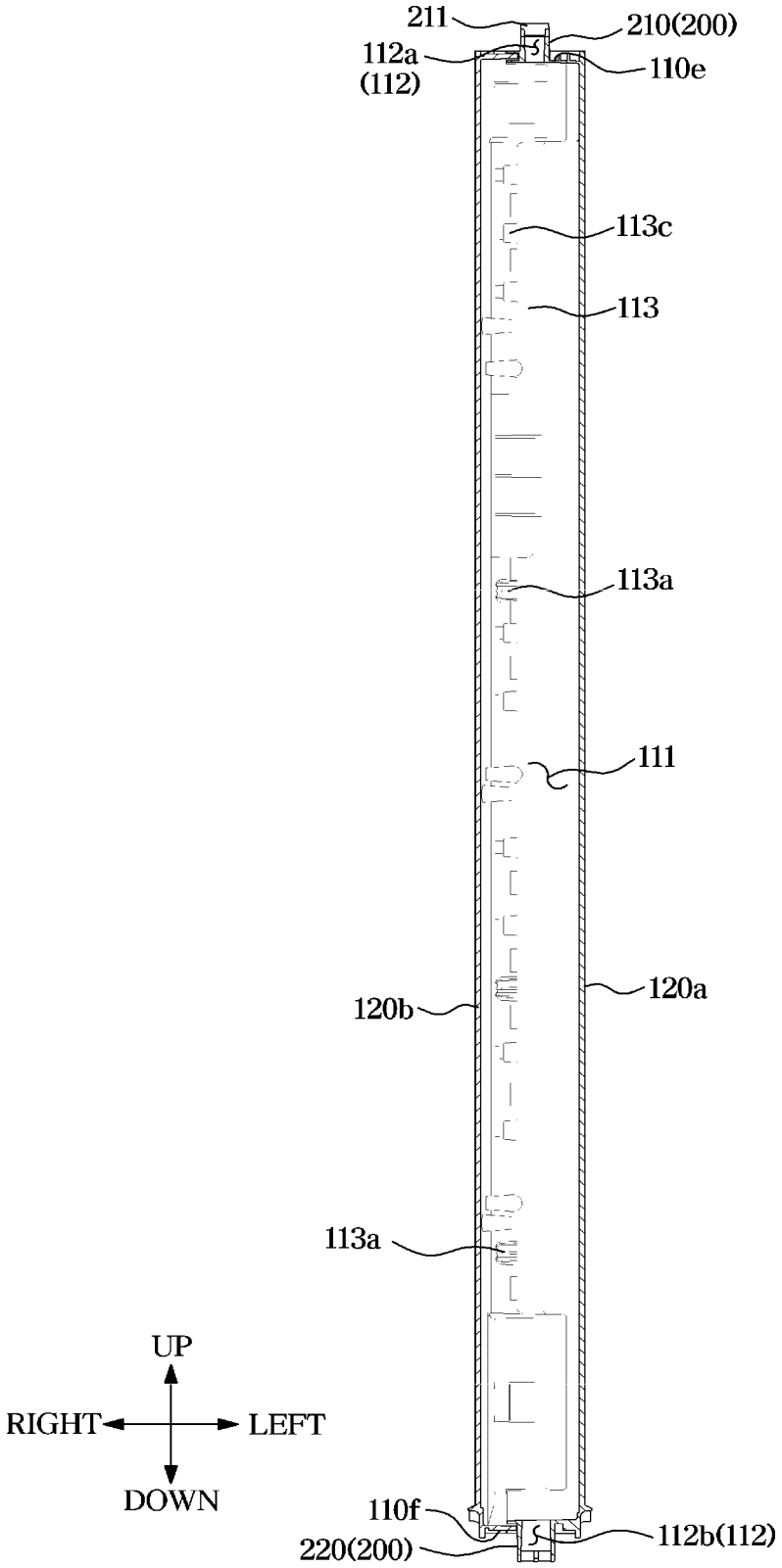
FIG. 11 is a cross-sectional view taken along line C-C of FIG. 5.
Figure 12:
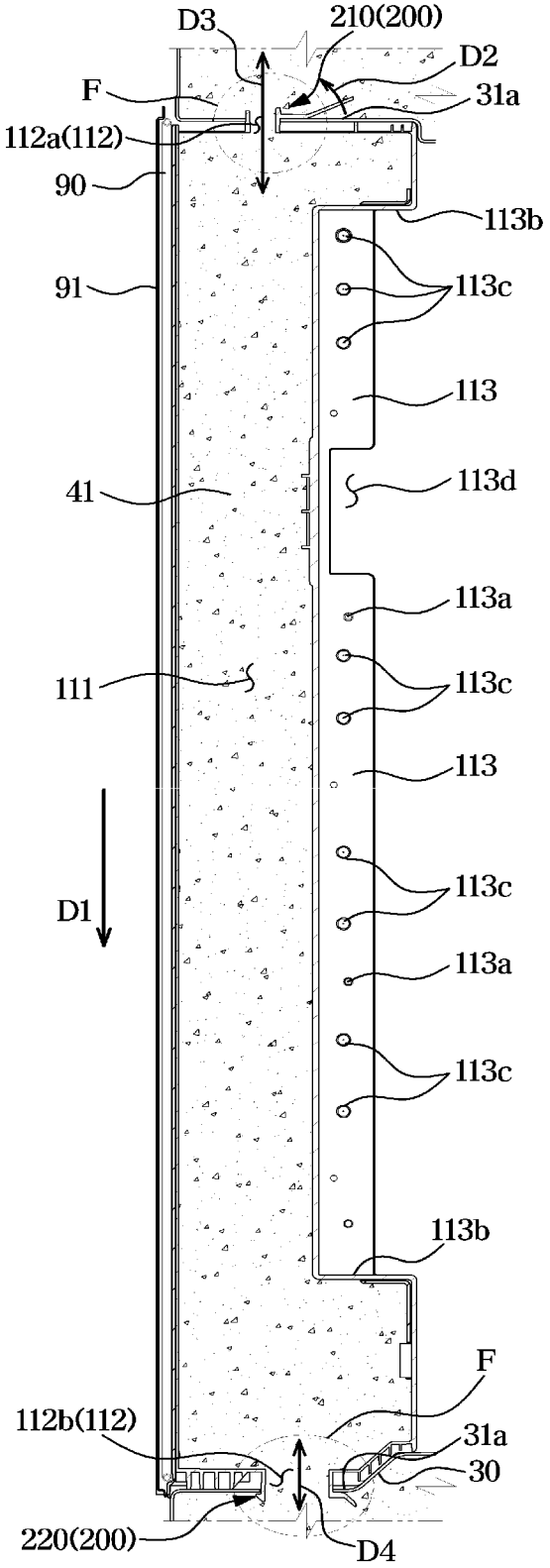
FIG. 12 is a cross-sectional view taken along line D-D of FIG. 5.
Figure 13:
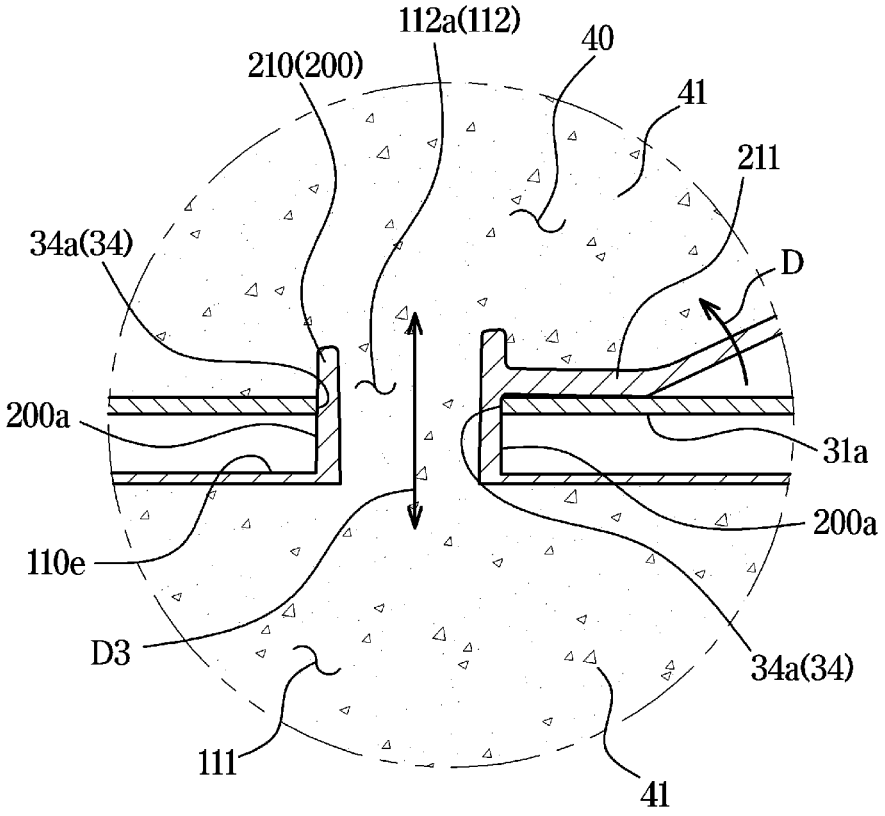
FIG. 13 is an enlarged view illustrating region E of FIG. 12.
Figure 14:
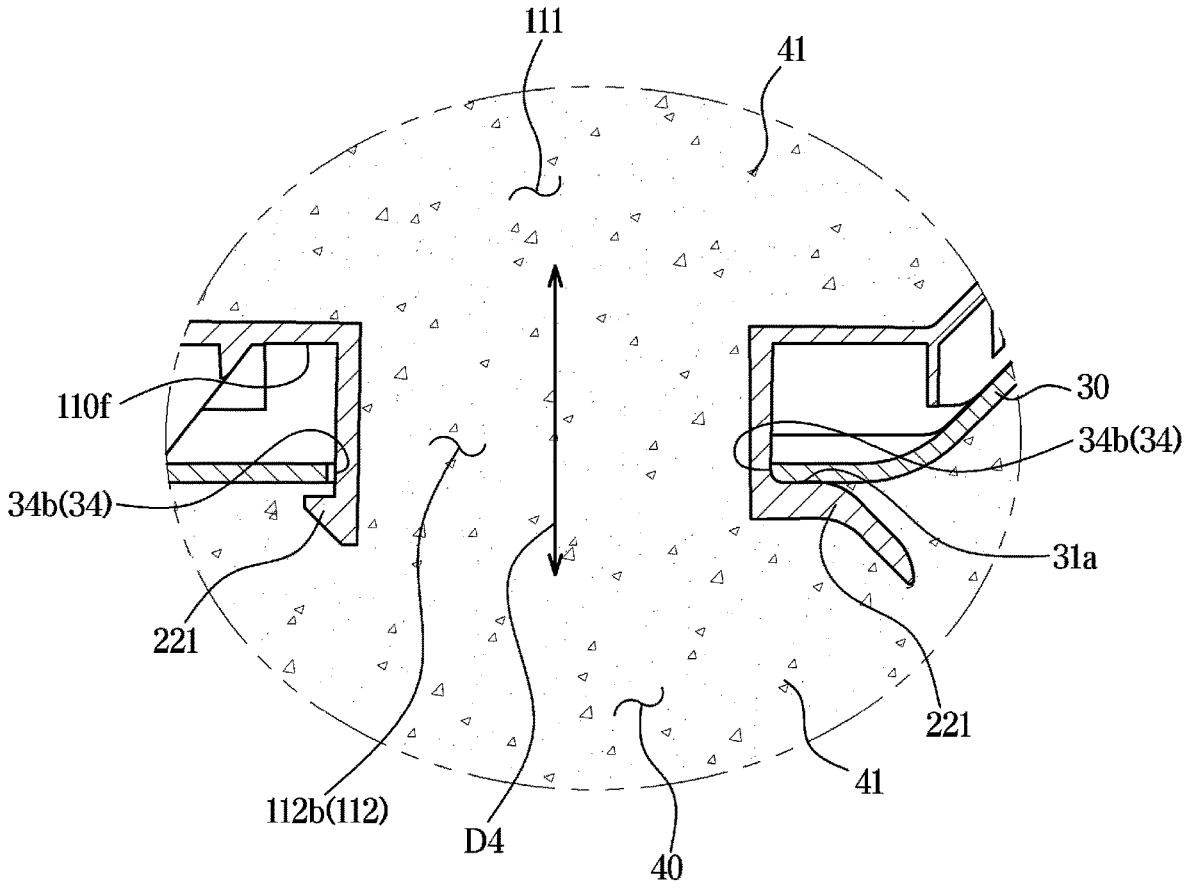
FIG. 14 is an enlarged view illustrating region F of FIG. 13.
Figure 15:
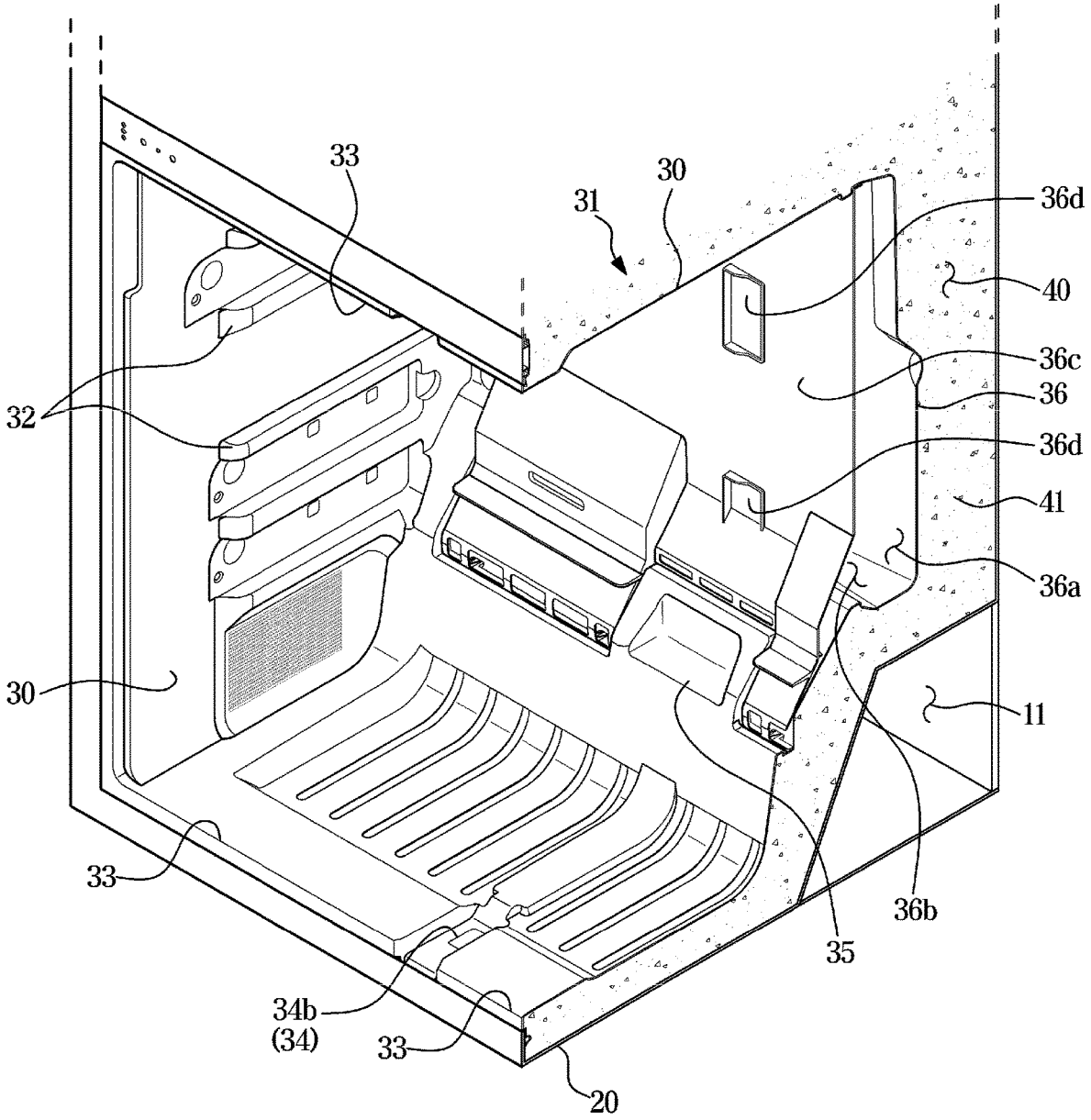
FIG. 15 is a view in which the first partition and the second partition are removed from FIG. 3.
Figure 16:
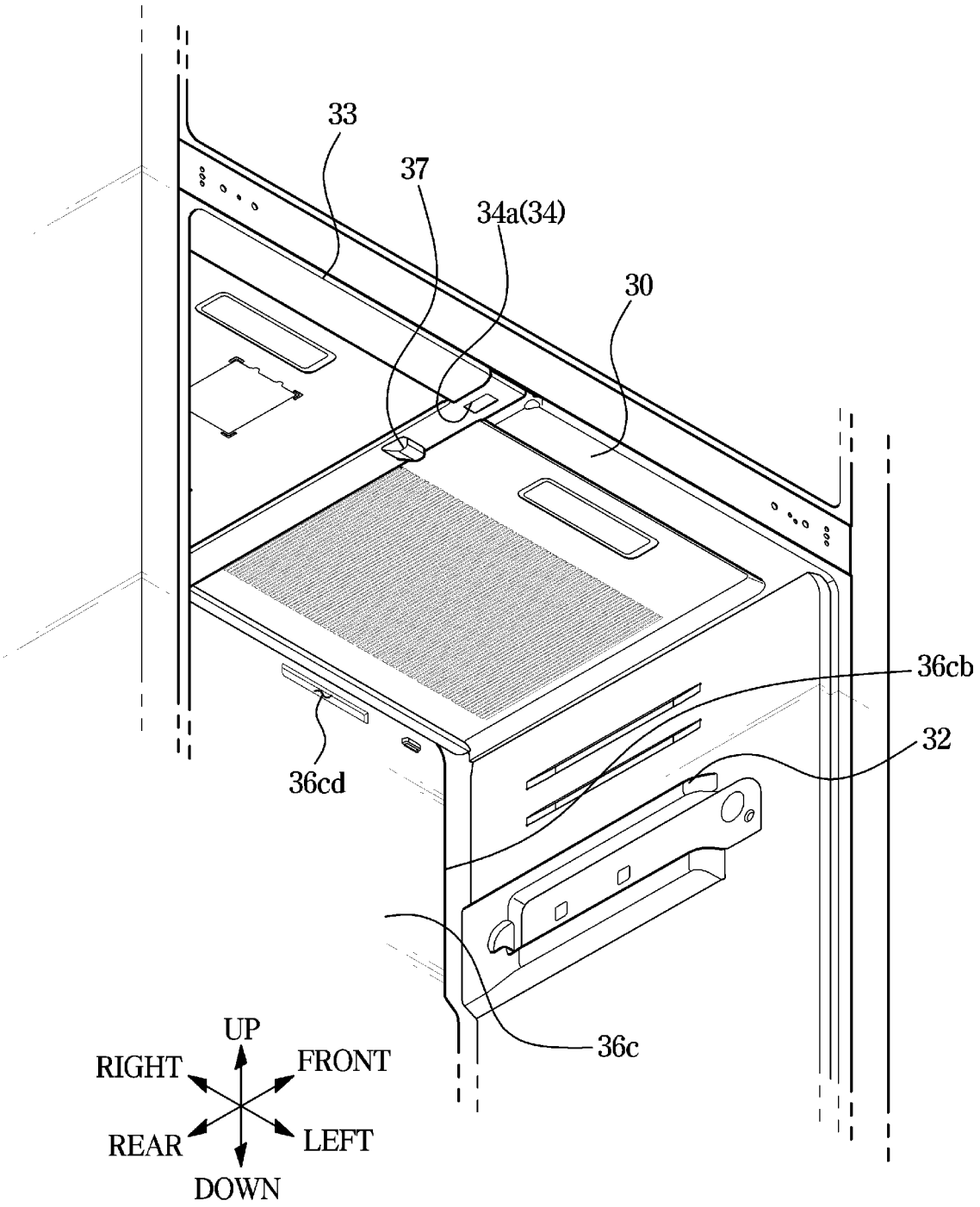
FIG. 16 is a partial perspective view illustrating a state in which the first partition and the second partition are removed from the refrigerator according to the embodiment of the disclosure.

FIG. 5 is a perspective view illustrating a first partition of the refrigerator according to the embodiment of the disclosure. FIG. 6 is a perspective view illustrating a lower portion of the first partition of the refrigerator according to the embodiment of the disclosure. FIG. 7 is a perspective view illustrating the first partition of the refrigerator according to the embodiment of the disclosure, when viewed in a different direction. FIG. 8 is an exploded perspective view illustrating the first partition of the refrigerator according to the embodiment of the disclosure. FIG. 9 is a cross-sectional view illustrating a first hook and a first fastening groove of the refrigerator according to the embodiment of the disclosure. FIG. 10 is a cross-sectional view illustrating a first sub-hook and a second sub-fastening groove of the refrigerator according to the embodiment of the disclosure. FIG. 11 is a cross-sectional view taken along line C-C of FIG. 5. FIG. 12 is a cross-sectional view taken along line D-D of FIG. 5. FIG. 13 is an enlarged view illustrating region E of FIG. 12. FIG. 14 is an enlarged view illustrating region F of FIG. 13. FIG. 15 is a view in which the first partition and the second partition are removed from FIG. 3. FIG. 16 is a partial perspective view illustrating a state in which the first partition and the second partition are removed from the refrigerator according to the embodiment of the disclosure.

The first partition 110 may be formed to extend in a first direction D1 parallel to the upper-lower direction and may be disposed adjacent to the opening 33. The first partition 110 may be provided in a rectangular parallelepiped shape in which the height in the upper-lower direction is longer than the width in the front-rear direction or left-right direction. The first partition 110 may have both ends 110*e* and 110*f* fixed to the inner case 30. The first partition 110 may be provided to be filled with the insulator 41.

The first partition 110 may include partition openings 112 provided at the both ends thereof 110*e* and 110*f* and configured to communicate with the filling part 40. The inner case 30 may further include a partition fixing opening 34 (see FIGS. 15 and 16) formed at a position corresponding to the partition opening 112. The partition opening 112 and the partition fixing opening 34 may be connected to each other. The insulator 41 may fill the filling part 40 (see FIGS. 2 and 3) and flow to a side adjacent to the partition fixing opening 34. The insulator 41 flowing to the partition fixing opening 34 passes through the partition fixing opening 34 and the partition opening 112 connected to the partition fixing opening 34 to finally flow into a hollow part 111 inside the first partition 110. The insulator 41 may pass through the partition opening 112 after passing through the partition fixing opening 34, but depending on the flow state of the insulator 41, may pass through the partition fixing opening 34 after passing through the partition opening 112. When sufficient time has elapsed after the insulator 41 is foamed, the insulator 41 may uniformly fill the filling part 40 and the hollow part 111 and hardened, and in this case, the insulator 41 may be hardened in a state of being fitted through the partition fixing opening 34 and the partition opening 112.

Therefore, in addition to a to-be described fixing structure provided at the both ends of the first partition 110, the insulator 41 hardened while fitted through the partition fixing opening 34 and the partition opening 112 may allow the first partition 110 to be firmly fixed to the inner case 30.

Referring to FIG. 8, the first partition 110 may be formed by coupling a left first partition 110*b* and a right first partition 110*a* to each other. The right first partition 110*a* may be coupled to the right side of the left first partition 110*b*.

Referring to FIG. 9, the right first partition 110*a* is provided at an edge thereof with a first hook 118*a*, and the left first partition 110*b* is provided at an edge thereof corresponding to the first hook 118*a* of the right first partition 110*a* with a first fastening groove 118*b* such that the right first partition 110*a* and the left first partition 110*b* may be coupled to each other.

Referring to FIG. 10, the right first partition 110*a* may include a first sub-hook 119*a* formed to protrude backward from a hot pipe seating part 110*c* to be described below. The left first partition 110*b* may include a seating support part

110*bb* in which a first sub fastening groove 119*b* corresponding to the first sub hook 119*a* is provided. The seating support part 110*bb* may be provided to support the hot pipe seating part 110*c* at the rear of the hot pipe seating part 110*c*. The hot pipe seating part 110*c* provided to seat the hot pipe 90 thereon may be provided between the left first partition 110*b* and the right first partition 110*a*. The hot pipe seating part 110*c* may be provided to space the left first partition 110*b* from the right first partition 110*a*. Referring to FIG. 5, the hot pipe seating part 110*c* may be disposed on the front surface of the first partition 110. The hot pipe seating part 110*c* may be provided in a rectangular shape in which the height in the upper-lower direction is longer than the width in the left-right direction to correspond to the shape of the first partition 110.

Referring to FIG. 8, the hot pipe seating part 110*c* may be provided to be disposed on the front side of the first partition 110 based on a state in which the first partition 110 is fixed to the inner case 30. Accordingly, the hot pipe seating part 110*c* may be disposed on the front side of the storage chamber 310.

The hot pipe 90 formed of a single refrigerant pipe may include a portion extending in parallel with the first partition 110. As shown in FIG. 4, the portion formed to extend by passing through the portion X extending from the edge of the inner case 30 along the circumference of the opening 33 to the first partition 110 or by passing through the portion X extending from the first partition 110 to the edge of the inner case 30 along the circumference of the opening 33 may be provided to extend in parallel with the first partition 110 and thus disposed on the hot pipe seating part 110*c*.

The hot pipe seating part 110*c* may be provided with a pipe fixing part (110*d* in FIG. 4). The pipe fixing part 110*d* clamps the circumference of the above-described portion of the hot pipe 90 such that the hot pipe 90 may be stably fixed to the hot pipe seating part 110*c*.

Referring to FIG. 5, although the hot pipe seating part 110*c* is provided between the left first partition 110*b* and the right first partition 110*a*, the hot pipe seating part 110*c* may have a structure formed to extend from one end of the right first partition 110*a* before the left first partition 110*b* and the right first partition 110*a* are coupled to each other. As shown in FIG. 4, in a state in which the left first partition 110*b* and the right first partition 110*a* are coupled, the hot pipe seating part 110*c* may be arranged between the left first partition 110*b* and the right first partition 110*a*. However, the disclosure is not limited thereto, and the hot pipe seating part 110*c* may have a structure formed to extend from one end of the left first partition 110*b* before the left first partition 110*b* and the right first partition 110*a* are coupled to each other.

Referring to FIGS. 5 to 6, the first partition 110 may further include a partition cover 91 formed to extend in parallel with the first partition 110 to cover the hot pipe 90 disposed on the hot pipe receiving part 110*c* to prevent the hot pipe 90 from being seen at the front. The partition cover 91 may be coupled to the front surface of the hot pipe seating part 110*c*.

The partition cover 91 may be provided in a shape corresponding to the hot pipe seating part 110*c*. Accordingly, the partition cover 91 may be provided in a rectangular shape in which the height in the upper-lower direction is longer than the width in the left-right direction to correspond to the shape of the hot pipe seating part 110*c*.

Referring to FIG. 8, the partition cover 91 may be provided at a rear surface thereof with a cover fastening part 91*a* to allow the partition cover 91 to be fixed to the hot pipe seating part 110*c*. The partition cover 91 may be coupled to the front of the hot pipe seating part 110*c*. A fastening part, such as a hook, may be provided along the edge of the partition cover 91, and the hot pipe seating part 110*c* may be also provided with a fastening part, such as a groove, at an edge thereof to correspond to the cover fastening part 91*a* so that the cover fastening part may be coupled to the hot pipe seating part 110*c*.

Referring to FIGS. 5 to 12, the first partition 110 may further include a first coupling part 113 formed to protrude backward from one surface of the first partition 110. The one surface of the first partition 110 from which the first coupling part 113 protrudes may be a surface located on the rear side of the first partition 110. The first coupling part 113 may be coupled to a second coupling part 123 of the second partition 120 while in contact with the second coupling part 123.

The left side surface of the first coupling part 113 may be bent to have a step from the left side surface of the left first partition 110*b*. The width in the left-right direction of the first coupling part 113 may be provided as about a half of the width in the left and right direction of the first partition 110 corresponding to a separation distance between the left side surface of the left first partition 110*b* and the right side surface of the right first partition 110*a*. The first coupling part 113 may be provided in the shape of a bar extending in an approximately upper-lower direction. The first coupling part 113 may include a rail seating part 113*d* formed as a recess in which a protruding rail part 126 (see FIG. 18) of the second partition 120 may be seated.

The first partition 110 may further include support parts 113*b* disposed at both ends of the first coupling part 113. The support parts 113*b* may be provided to support both ends of the second coupling part 123 of the second partition 120 coupled to the first coupling part 113 in the upper-lower direction. Alternatively, without the support parts 113*b* of the first partition 110, the second coupling part 123 of the second partition 120 may be formed to have a height corresponding to a height of the first partition 110 such that both ends of the second coupling part 123 are directly supported on the bottom surface of the inner case 30 and the intermediate partition 31.

The first coupling part 113 may be formed with a first fastening hole 113*a*. The first fastening hole 113*a* may be provided to correspond to a second fastening hole 123*b* formed in the second coupling part 123 of the second partition 120 to be described below. The first partition 110 and the second partition 120 may be coupled to each other by a fastening member C simultaneously passing through the first fastening hole 113*a* and the second fastening hole 123*b*. A female screw structure may be provided on inner surfaces of the first fastening hole 113*a* and the second fastening hole 123*b*, and a male screw structure may be provided on an outer circumferential surface of the fastening member C. In FIG. 7, each of the first fastening hole 113*a* and the second fastening hole 123*b* is provided in two units thereof, but the disclosure is not limited thereto.

The first coupling part 113 may be provided with not only the first fastening holes 113*a* but also with a plurality of discharge ports 113*c*. The plurality of discharge ports 113*c* may be arranged in line with each other in the upper-lower direction along the extending direction of the first coupling part 113. The plurality of discharge ports 113*c* may be provided to communicate the hollow part 111 inside the first partition 110 with the outside of the first partition 110, that is, with the storage chamber 310. As the insulator 41 fills the hollow part 111, air remaining inside the hollow part 111 may be discharged to the outside of the first partition 110 through the plurality of discharge ports 113*c*. With the plurality of discharge ports 113*c*, the insulator 41 may uniformly fill the hollow part 111 of the first partition 110.

Referring to FIG. 8, the above-described first coupling part 113 or support part 113*b* is illustrated as being formed on the left first partition 110*b*, but the present disclosure is not limited thereto, and the first coupling part 113 or support part 113*b* may be formed on the right first partition 110*a*.

Referring to FIGS. 5 to 14, the first partition 110 may include the partition openings 112 formed at the both ends 110*e* and 110*f* of the first partition 110. The partition openings 112 may include a first partition opening 112*a* formed at one end 110*e* of the first partition 110 and a second partition opening 112*b* formed at the other end of the first partition 110. The one end 110*e* of the first partition 110 may represent an upper end of the first partition 110, and the other end 110*f* of the first partition 110 may represent a lower end of the first partition 110.

The inner case 30 may further include the partition fixing opening 34 (see FIGS. 15 and 16) formed at a position corresponding to the partition opening 112. The partition fixing opening 34 may include a first partition fixing opening 34*a* provided at a position corresponding to the first partition opening 112*a* and a second partition fixing opening 34*b* provided at a position corresponding to the second partition opening 112*b*. The partition fixing opening 34 may be formed by punching in a process of producing the inner case 30 such that the filling part 40 and the storage chamber 310 communicate with each other.

The insulator 41 may pass through the first partition opening 112*a* and the first partition fixing opening 34*a* or may pass through the second partition opening 112*b* and the second partition fixing opening 34*b* to thereby fill the filling part 40 and the hollow part 111.

Referring to FIGS. 11 to 14, the first partition 110 may further include a communication part 200 provided to connect the partition opening 112 and the partition fixing opening 34 to each other. The communication parts 200 may be formed to protrude from the both ends 110*e* and 110*f* of the first partition 110 in the upper-lower direction while surrounding the partition openings 112. The communication part 200 may have a side surface supported by an inner surface of the partition fixing opening 34.

The communication part 200 may be provided in a substantially rectangular parallelepiped shape having upper and lower sides thereof open. The partition opening 112 may be disposed at the center of the communication part 200. Therefore, the communication part 200 may be provided in a structure surrounding the partition opening 112. The partition opening 112 may have an upper end connected to the opening formed on the upper side of the communication part 200, and have a lower end connected to the opening formed on the lower surface of the communication part 200.

Since the side surface of the communication part 200 is supported by the inner surface of the partition fixing opening 34, the partition fixing opening 34 may be provided in a shape corresponding to the circumference of the side surface of the communication part 200. Referring to FIGS. 13 to 16, the partition fixing opening 34 may have a substantially rectangular shape. However, the shapes of the communication part 200 and the partition fixing opening 34 are not limited thereto.

The communication part 200 may include a first communication part 210 corresponding to the first partition opening 112*a* and a second communication part 220 corresponding to the second partition opening 112*b*.

The first communication part 210 may include a first fixing hook 211 formed to extend from one end of the first communication part 210 and enable elastic deformation. The first fixing hook 211 may be formed to extend in a direction in which the first partition 110 is inserted into the storage chamber 310 formed inside the inner case 30 such that the first partition 110 is fixed to the inner case 30. The first fixing hook 211 may perform a guide function through which the first communication part 210 may be stably inserted into the first partition fixing opening 34*a*.

When the first communication part 210 is fully inserted into the first partition fixing opening 34*a* and thus the side surface of the first communication part 210 is supported on the inner surface of the first partition fixing opening 34*a*, the first fixing hook 211 may be supported on the surface 31*a* of the inner case 30 that is positioned at a circumference of the first partition fixing opening 34*a* while facing the filling portion 40.

The second communication part 220 may include a second fixing hook 221 that is formed to extend from one end of the second communication part 220. The second fixing hook 221 may be formed to extend in a direction in which the second partition 120 is inserted into the storage chamber 310 inside the inner case 30 so as to be fixed to the inner case 30. Alternatively, the second fixing hook 221 may also be formed to extend in a direction opposite to the above-described insertion direction. The extension length of the second fixing hook 221 extending in the insertion direction and the extension length of the second fixing hook 221 extending in the opposite direction to the insertion direction may be provided to be different from each other. Referring to FIG. 14, the extension length of the second fixing hook 221 extending in the insertion direction may be longer than the extension length of the second fixing hook 221 extending in the opposite direction to the insertion direction. The second fixing hook 221 may perform a guide function through which the second communication part 220 may be stably inserted into the second partition fixing opening 34*b*. In addition, with a hook structure extending in various directions, the second communication part 220 may be more firmly fixed to the second partition fixing opening 34*b*.

When the second communication part 220 is fully inserted into the second partition fixing opening 34*b* and the side surface of the second communication part 220 is supported on the inner surface of the second partition fixing opening 34*b*, the second fixing hook 221 may be supported on the surface 31*a* of the inner case 30 that is positioned at a circumference of the second partition fixing opening 34*b* while facing the filling portion 40.

Referring to FIG. 13, the insulator 41 may sequentially pass through the filling part 40, the first partition fixing opening 34*a*, and the first partition opening 112*a* to finally fill the hollow part 111. Alternatively, depending on a position of the filling part 40 in which the insulator 41 is initially injected, the insulator 41 may sequentially pass through the hollow part 111, the first partition fixing opening 34*a*, and the first partition opening 112*a* to finally fill the filling part 40. That is, the insulator 41 may flow in the upper-lower direction along an extension direction D3 of the first communication part 210.

Referring to FIG. 14, the insulator 41 may sequentially pass through the filling part 40, the second partition fixing opening 34*b*, and the second partition opening 112*b* to finally fill the hollow part 111. Alternatively, depending on a position in the filling part 40 in which the insulator 41 is initially injected, the insulator 41 may sequentially pass through the hollow part 11, the second partition fixing opening 34*b*, and the second partition opening 112*b* to finally fill the filling part 40. That is, the insulator 41 may flow in the upper-lower direction along an extension direction D4 of the second communication part 220.

Figure 17:
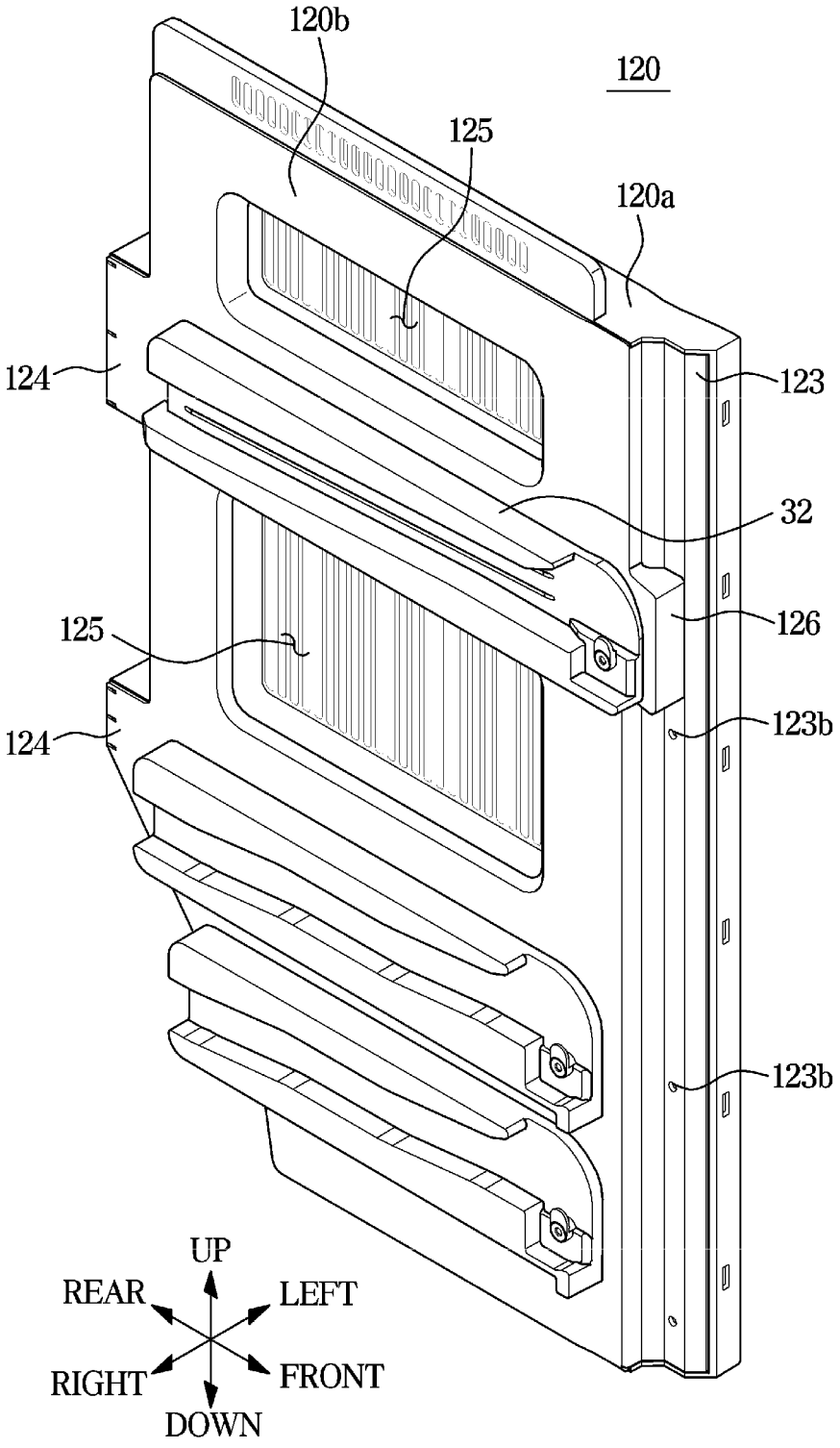
FIG. 17 is a perspective view illustrating the second partition of the refrigerator according to the embodiment of the disclosure.
Figure 18:
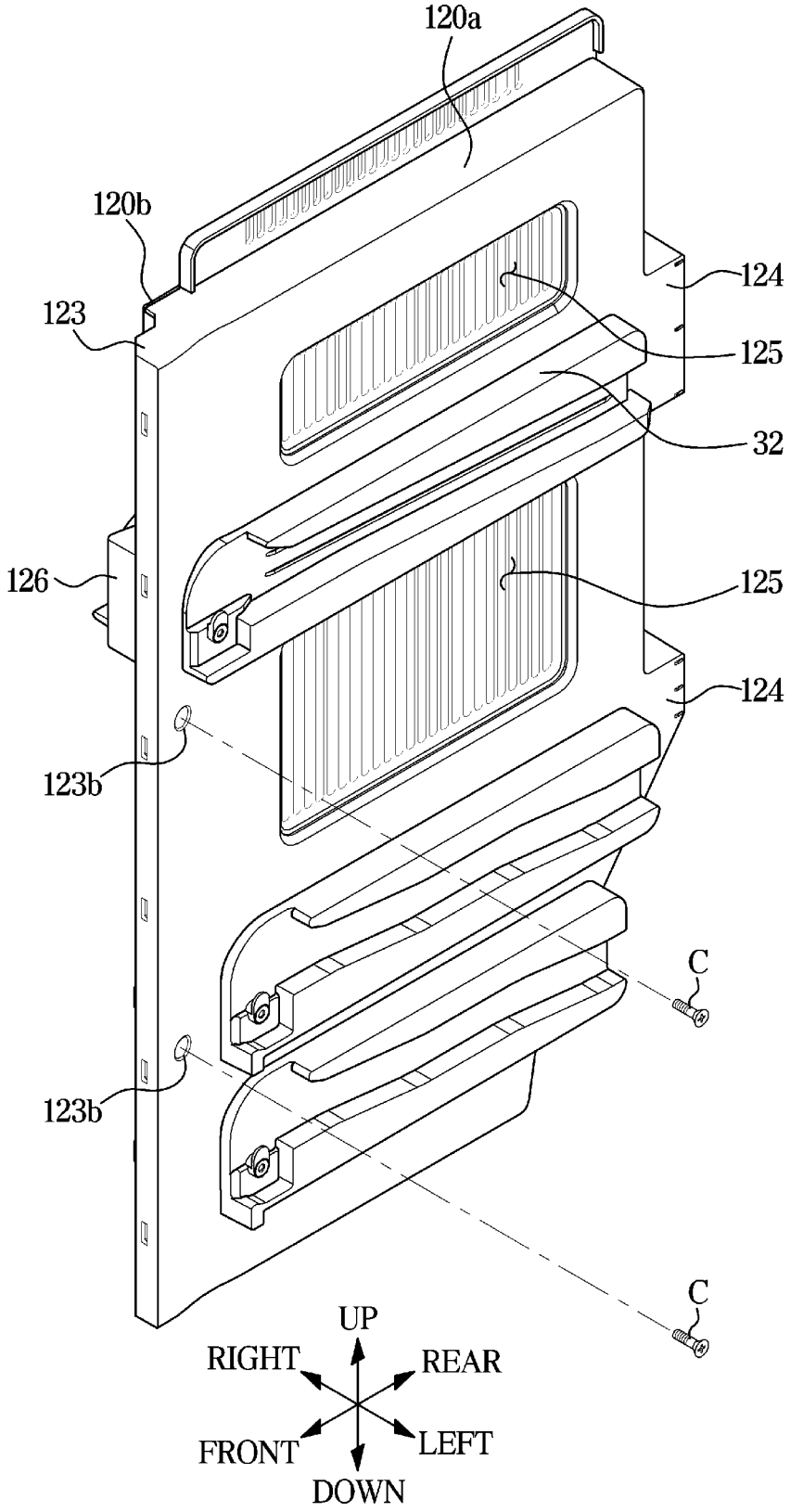
FIG. 18 is a perspective view illustrating the second partition of the refrigerator according to the embodiment of the disclosure when viewed from a different direction.
Figure 19:
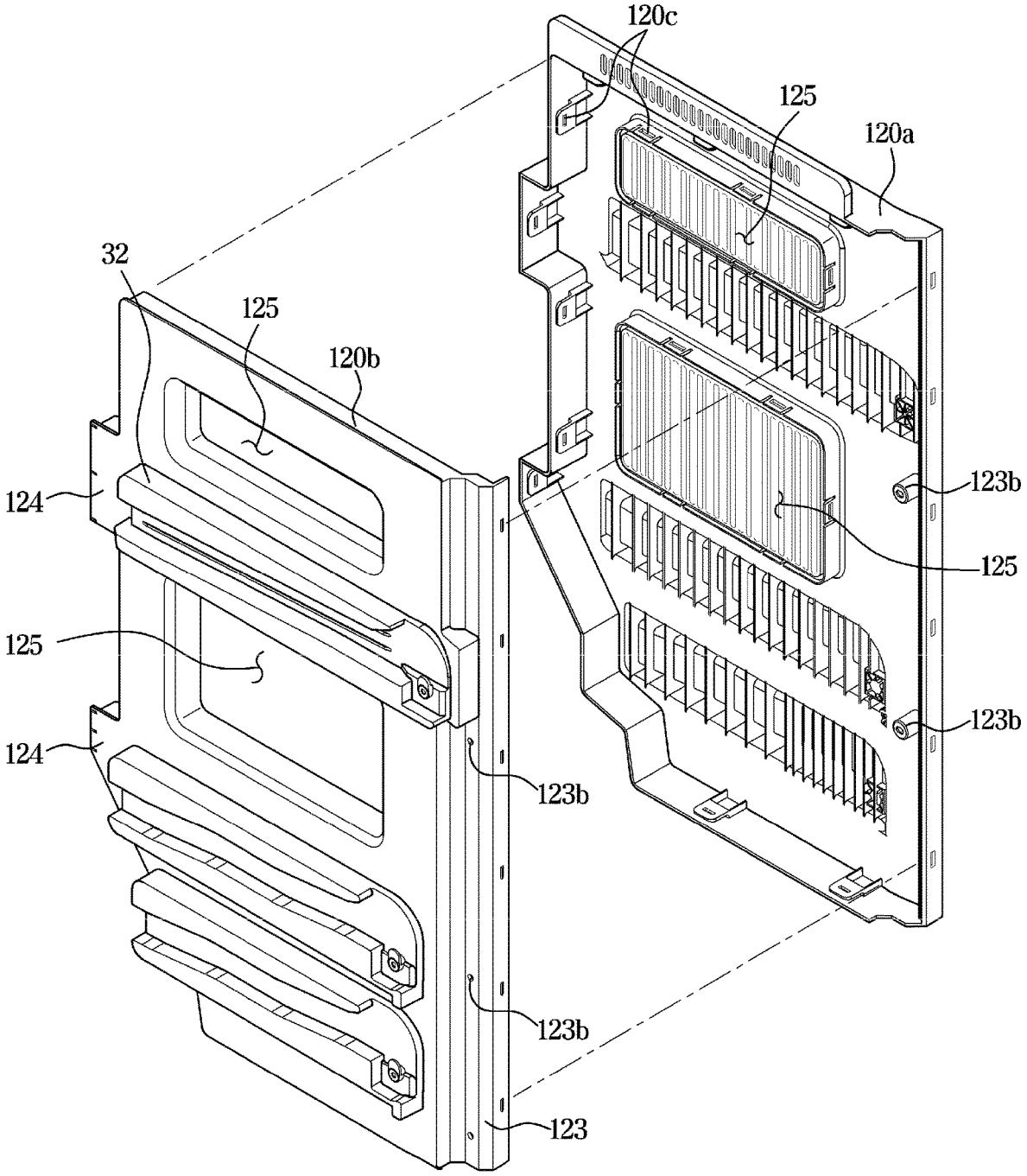
FIG. 19 is an exploded perspective view the refrigerator the second partition of the refrigerator according to the embodiment of the disclosure.

FIG. 17 is a perspective view illustrating the second partition of the refrigerator according to the embodiment of the disclosure. FIG. 18 is a perspective view illustrating the second partition of the refrigerator according to the embodiment of the disclosure when viewed from a different direction. FIG. 19 is an exploded perspective view the refrigerator the second partition of the refrigerator according to the embodiment of the disclosure.

The second partition 120 may be coupled to the first partition 110 to form partitioning parts that divide the storage chamber into a plurality of storage chambers.

The second partition 120 while being coupled to the first partition 110 may be provided to press the center of the evaporator cover 36*c* toward the rear wall 36. In order for the second partition 120 to stably press the center of the evaporator cover 36*c* toward the rear wall 36, the second partition 120 may include a second partition support part 124 that is formed to protrude rearward toward the evaporator cover 36*c* in a state in which the second partition 120 is coupled to the first partition 110. The evaporator cover 36*c* may further include a second partition seating part 36*d* at a position corresponding to the second partition support part 124. Referring to FIGS. 2 and 17 to 19, the second partition support part 124 may have a longitudinal cross-section in a rectangular or trapezoidal shape. The second partition support part 124 may be provided in plural. The plurality of second partition support parts 124 may be formed to protrude from the rear surface of the second partition 120 and may be arranged to be spaced apart from each other in the upper-lower direction.

The second partition seating part 36*d* may keep the second partition 120 in position while surrounding at least a portion of the second partition support part 124.

Referring to FIGS. 2 and 3, the second partition 120 may be seated not only on the second partition seating part 36*d* formed in the evaporator cover 36*c* but also seated on a recessed part 35 formed by at least a region of the inner case 30 being recessed, so as to be supported by the inner case 30.

Similar to the first partition 110, the second partition 120 may be provided in a rectangular parallelepiped shape in which the height in the upper-lower direction is longer than the width in the front-rear direction or left-right direction. However, the width in the front-rear direction of the second partition 120 may be greater than the width in the front-rear direction of the first partition 110. With such a configuration, a space for disassembling the evaporator cover 36*c* may be sufficiently secured by only separating the second partition 120 to the outside of the storage chamber 310 without removing the first partition 110.

The second partition 120 may be formed by coupling a left side second partition 120*a* and a right side second partition 120*b* to each other. The right side second partition 120*b* may be coupled to the right side of the left side second partition 120*a*. The left side second partition 120*a* may be provided at an edge thereof with a fastening part 120*c*, such as a hook, and the right side second partition 120*b* may also be provided at an edge thereof corresponding to the fastening part of the left side second partition 120*a* with a fastening part, such as a groove, so that the right side second partition 120*b* and the left side second partition 120*a* may be coupled to each other.

However, unlike the first partition 110, the second partition 120 may have a space between the right side second partition 120*b* and the left side second partition 120*a* that is provided as an empty space not filled with the insulator 41.

Therefore, the second partition 120 may be formed with a partition cold air flow part 125. The partition cold air flow part 125 allows a cold air flow to be formed between the left storage chamber 312*b* and the right storage chamber 312*a*, and allows the refrigerating or freezing temperature of the left storage chamber 312*b* and the right storage chamber 312*a* to be kept the same.

The partition cold air flow part 125 includes a grill part provided in the left side second partition 120*a* and an opening formed in the right side second partition 120*b* to correspond to the grill part, and as the left side second partition 120*a* and the right side second partition 120*b* are coupled, the partition cold air flow part 125 is formed.

The second partition 120 may be provided on left and right sides thereof with a plurality of rails 32. The plurality of rails 32 of the second partition 120 may be provided to correspond to the plurality of rails 32 provided on the inner case 30.

The second partition 120 may further include a second coupling part 123 formed to protrude from one surface of the second partition 120 to correspond to the first coupling part 113. The one surface of the second partition 120 from which the second coupling part 123 protrudes may be a surface located on the front side of the second partition 120. The second coupling part 123 may be coupled to and come in contact with the first coupling part 113 of the first partition 110 described above.

The right side surface of the second coupling part 123 may be bent to have a step from the right side surface of the right second partition 120*b*. The width in the left-right direction of the second coupling part 123 may be provided as about a half of the width in the left-right direction of the second partition 120 corresponding to a separation distance between the left side surface of the left second partition 120*a* and the right side surface of the right second partition 120*b*. The second coupling part 123 may be provided in the shape of a bar extending in an approximately upper-lower direction. Both ends of the second coupling part 123 may be vertically supported by support parts 113*b* of the first partition 110.

The partitioning parts formed by the first partition 110 and the second partition 120 may allow cold air to flow from the left storage chamber 312*b* to the right storage chamber 312*a* or from the right storage chamber 312*a* to the left storage chamber 312*b* through a lower side of the second partition 120 or a cold air flow part 125 formed between the plurality of second partition support parts 124 of the second partition 120.

However, the structure of the second partition 120 is not limited to the structure described above and may be provided in a structure in which the partition cold air flow part 125, that is, the grill part, may be omitted. In addition, the second partition 120 may have a circumference directly supported on the inner case 30, the intermediate partition 31, the evaporator cover 36*c*, and the first partition 110 rather than forming the cold air flow part 125 described above.

Figure 20:
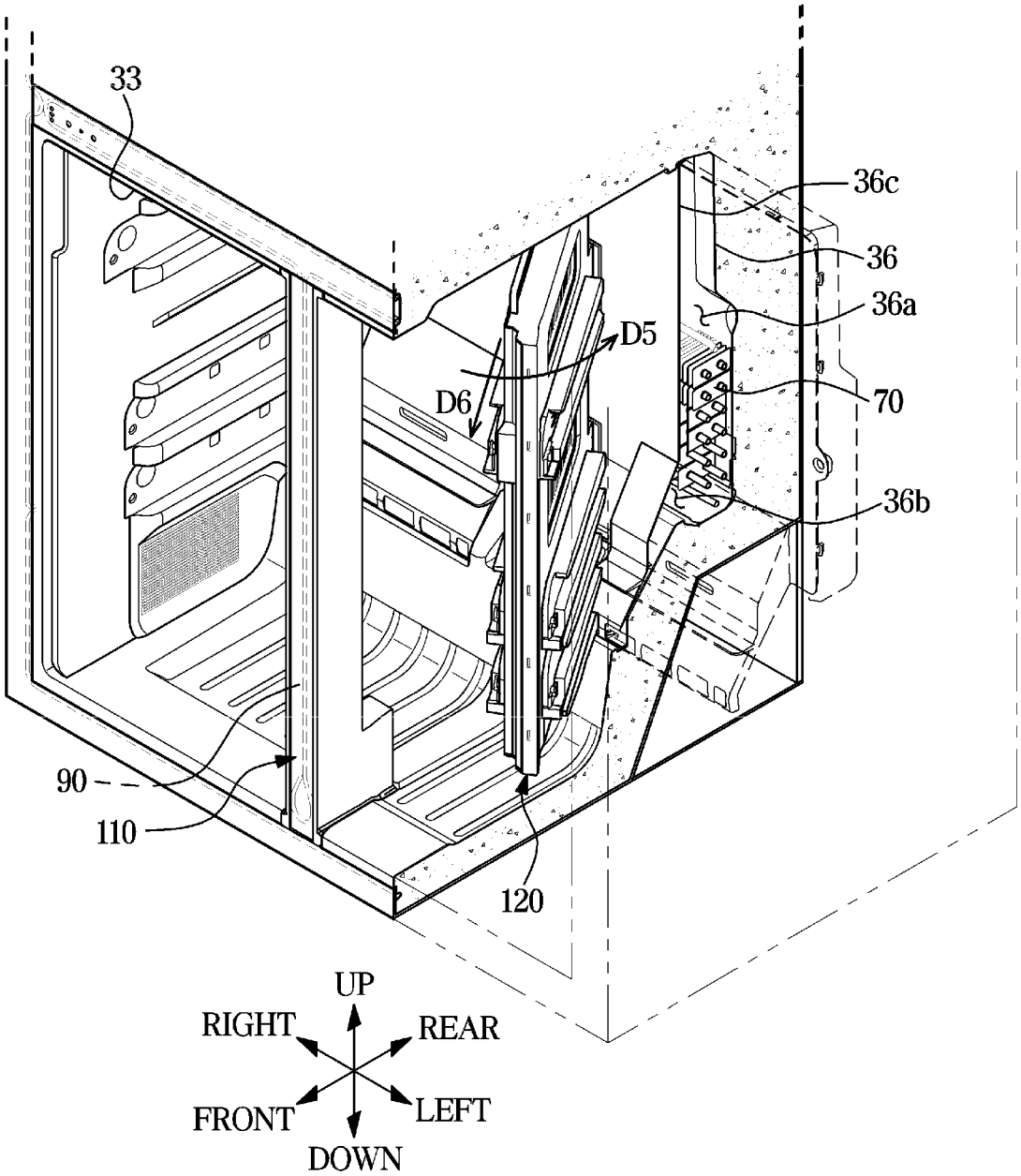
FIG. 20 is a view illustrating a process of disassembling the second partition from the storage chamber of the refrigerator and withdrawing the second partition to the outside of the refrigerator according to the embodiment of the disclosure.
Figure 21:
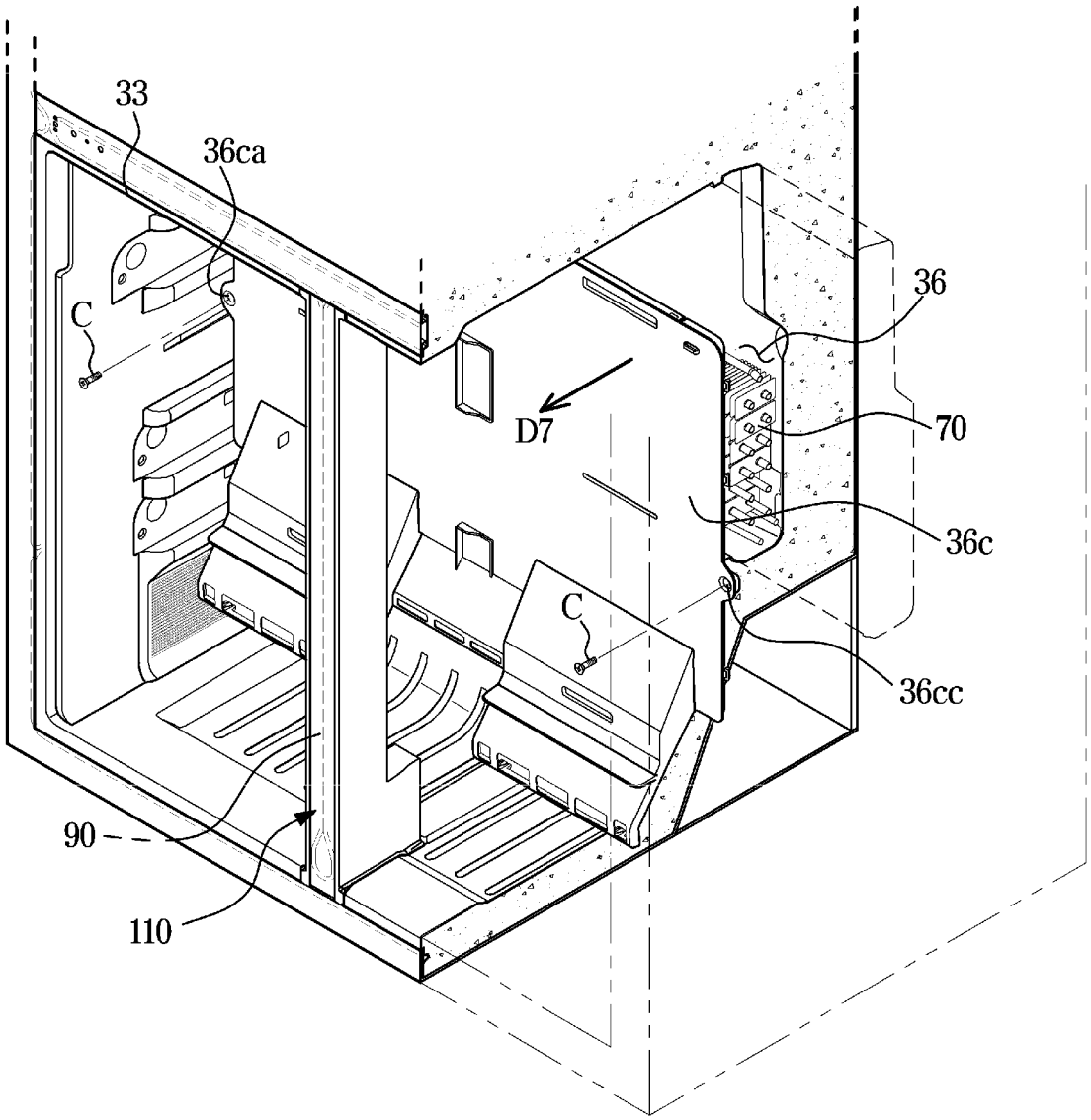
FIG. 21 is a view the refrigerator a process of disassembling an evaporator cover from an evaporator seating part of the refrigerator according to the embodiment of the disclosure.
Figure 22:
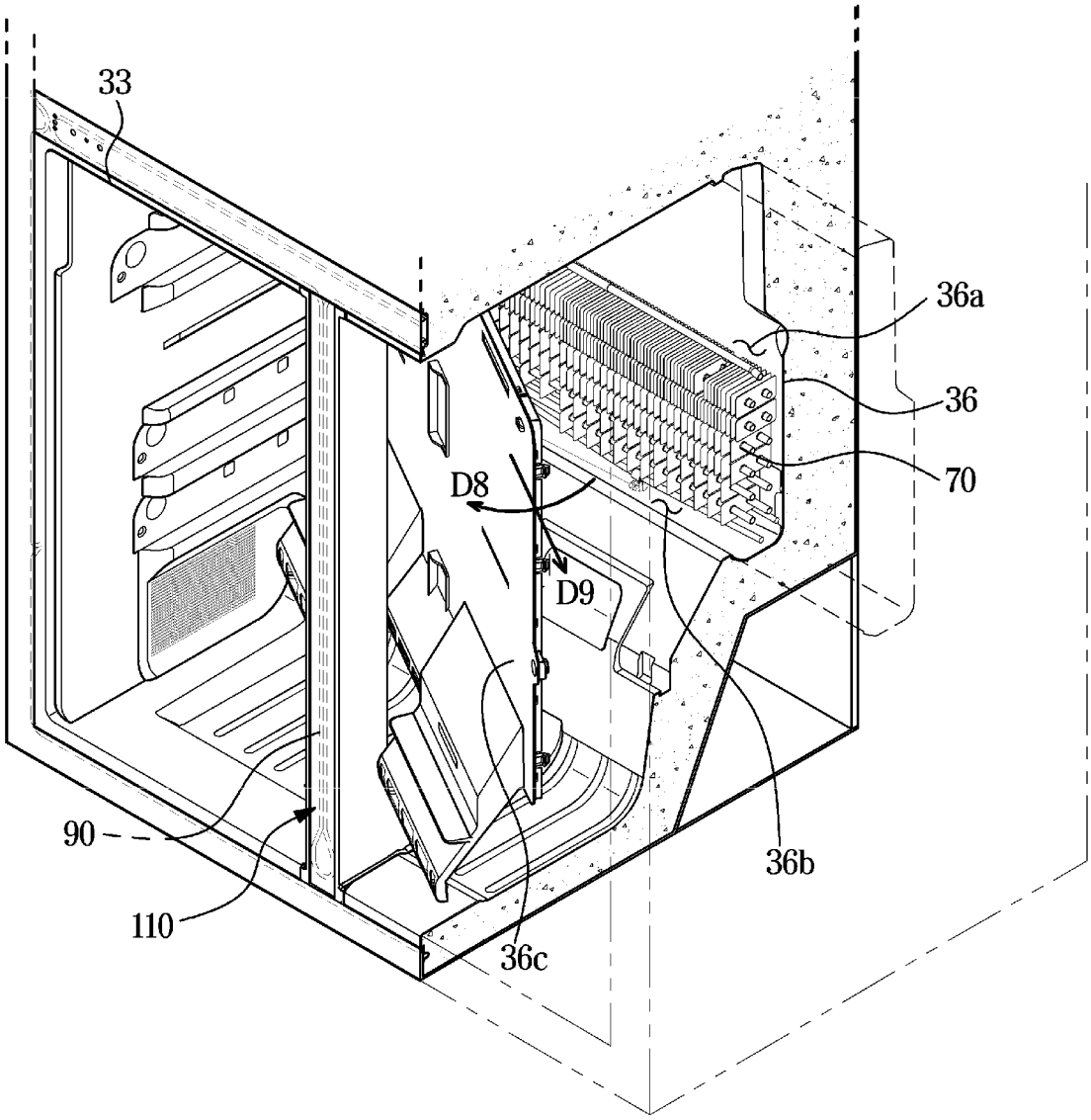
FIG. 22 is a view illustrating a process of withdrawing the evaporator cover from the storage chamber of the refrigerator according to the embodiment of the disclosure.

FIG. 20 is a view illustrating a process of disassembling the second partition from the storage chamber of the refrigerator and withdrawing the second to the outside of the refrigerator according to the embodiment of the disclosure. FIG. 21 is a view the refrigerator a process of disassembling an evaporator cover from an evaporator seating part of the refrigerator according to the embodiment of the disclosure. FIG. 22 is a view illustrating a process of withdrawing the evaporator cover from the storage chamber of the refrigerator according to the embodiment of the disclosure.

Referring to FIG. 20, in the initial state in which the first partition 110 and the second partition 120 are coupled to each other as shown in FIG. 3, the fastening member (C in FIGS. 7 and 18) coupling the first partition 110 to the second partition 120 is released, the front end of the second partition 120 may be rotated in a direction D5, and then the second partition 120 may be withdrawn in a direction D6 toward the opening 33.

Referring to FIG. 21, the fastening member C fixing the evaporator cover 36*c* to the inner case 30 may be released from the cover fixing part 36*cc*, and the evaporator cover 36*c* may be moved from the evaporator seating opening 36*b* in a direction D7.

Referring to FIG. 22, the evaporator cover 36*c* may be rotated in a direction D8, and then moved in a direction D9 toward the opening 33 to be withdrawn out of the storage chamber 310.

The structure of the first partition 110, the second partition 120, and the inner case 30 described above may facilitate repair of the evaporator 70 inside the storage chamber 310 by only withdrawing the second partition 120 from the storage chamber 310 without needing to separate the first partition 110 from the storage chamber 310. Since there is no need to separate the first partition 110 from the storage chamber 310, damage to the hot pipe 90 formed along the first partition 110 may be minimized.

After the repair is completed, the above-described process may be performed in reverse to fix the evaporator cover 36*c* and the second partition 120 to the inside of the storage chamber 310.

Figure 23:
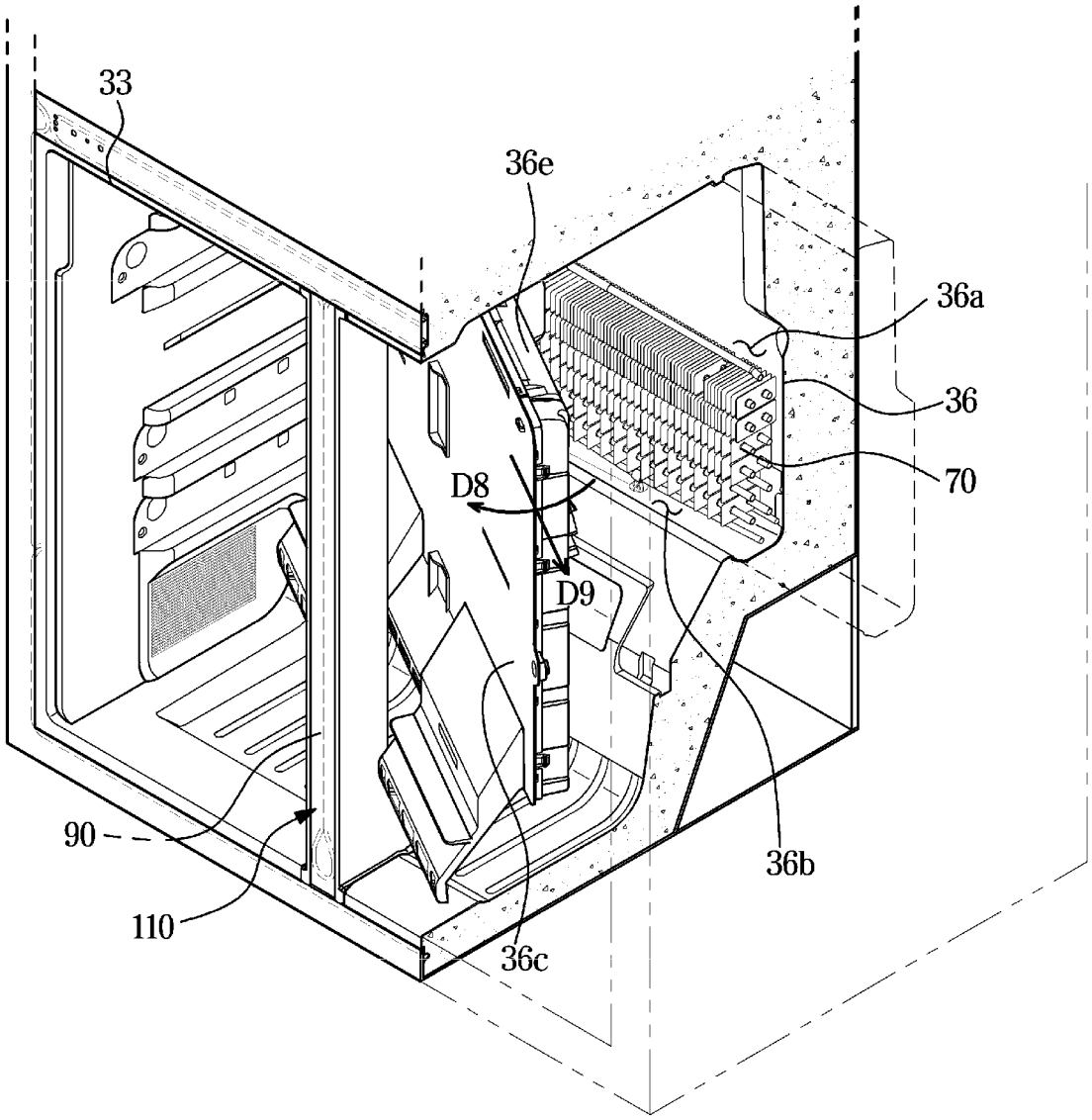
FIG. 23 is a view illustrating a process of withdrawing the evaporator cover and a guide duct from the storage chamber of the refrigerator according to the embodiment of the disclosure.
Figure 24:
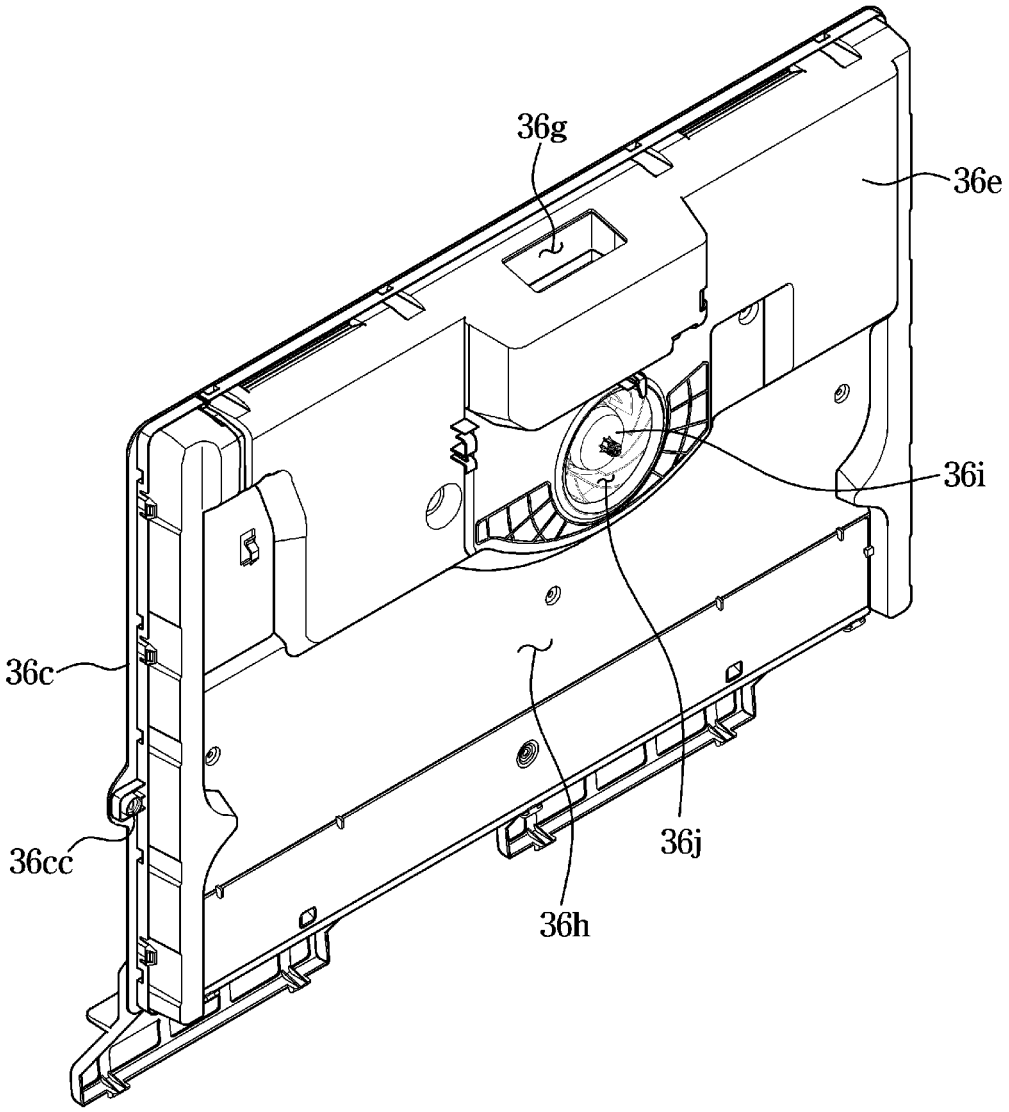
FIG. 24 is a rear view illustrating the guide duct of the refrigerator according to the embodiment of the disclosure.
Figure 25:
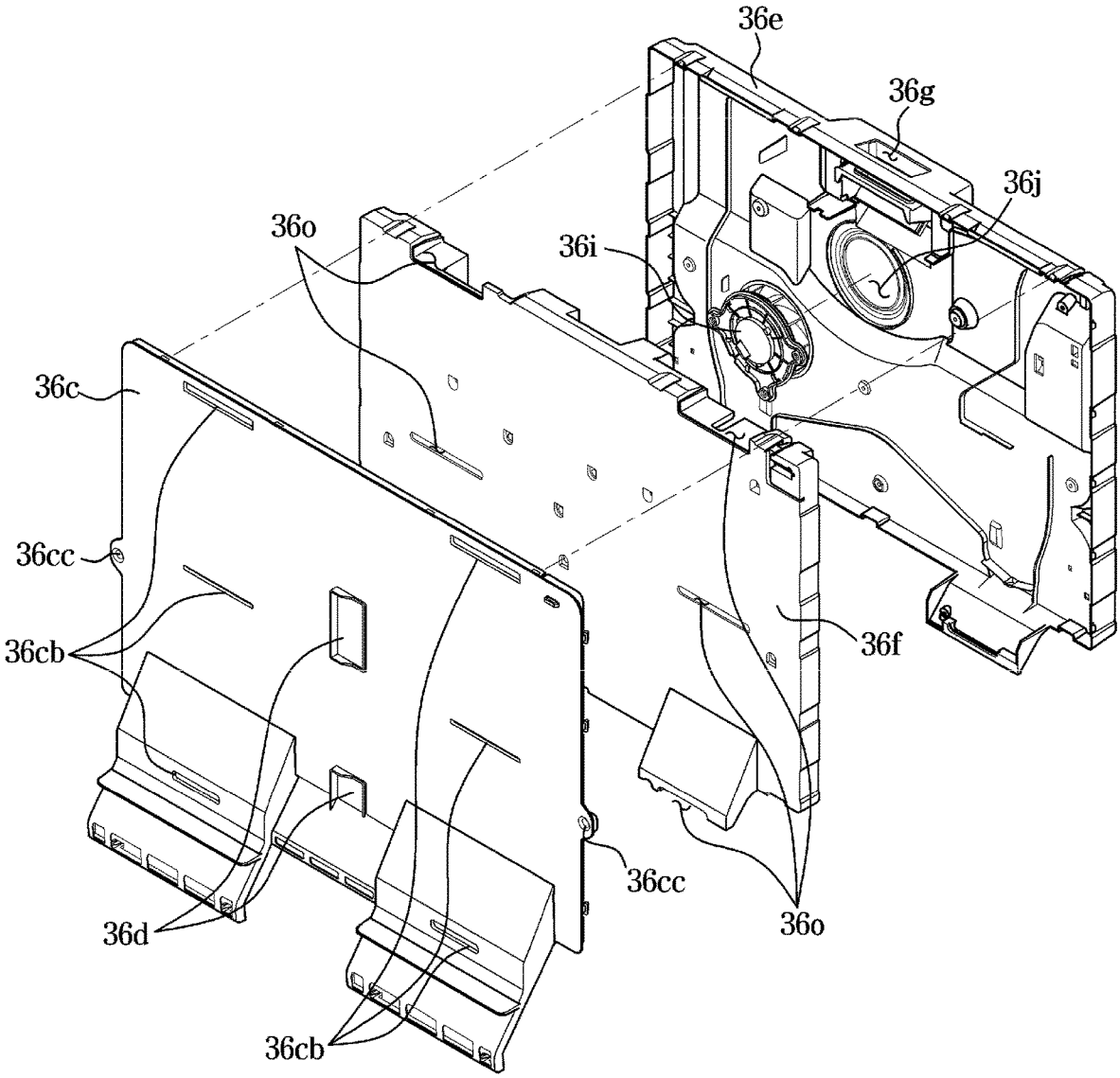
FIG. 25 is an exploded perspective view illustrating the evaporator cover and the guide duct according to the disclosure.

FIG. 23 is a view illustrating a process of withdrawing the evaporator cover and a guide duct from the storage chamber of the refrigerator according to the embodiment of the disclosure. FIG. 24 is a rear view illustrating the guide duct of the refrigerator according to the embodiment of the disclosure. FIG. 25 is an exploded perspective view illustrating the evaporator cover and the guide duct according to the disclosure.

The cold air duct 50 may further include the guide duct (53 in FIG. 2). The guide duct 53 may be disposed behind the evaporator cover 36*c* and may be provided to communicate the cold air discharge port 36*cb* with the evaporator seating part 36*a*.

Referring to FIGS. 2, 23, and 24, the evaporator cover 36*c* may be coupled to the inner case 30 so as to be disposed in front of the guide duct 53. The guide duct 53 may be provided in a shape corresponding to the evaporator seating part 36*a*. The guide duct 53 may be seated on the evaporator seating part 36*a* so as to be positioned over the front side and the upper side of the evaporator 70. The evaporator cover 36*c* may be fixed to the inner case 30 while pressing the guide duct 53 at the front side of the guide duct 53 such that the guide duct 53 may be fixed to the evaporator seating part 36*a*.

The evaporator cover 36*c* may be fixed to the inner case 30, but separately from the structure fixed to the inner case 30, the evaporator cover 36*c* may be coupled to a guide part 36*f* of the guide duct 53.

Referring to FIG. 22, only the evaporator cover 36*c* may be primarily separated from the storage chamber 310, but referring to FIG. 23, the evaporator cover 36*c* may be separated from the storage chamber 310 together with the guide duct 53.

The guide duct 53 may include a guide part 36*f* provided to form a flow path for guiding the flow of cold air and allowing a fan 36*i* to be seated and fixed thereon and a rear cover 36*e* disposed behind the guide part 36*f* and allowing the guide part 36*f* to be seated thereon.

Referring to FIG. 24, the rear cover 36*e* may be provided with a rear surface thereof with a cover recess part 36*h* in which the evaporator 70 is seated. Since the cover recess part 36*h* is formed by a portion of a rear surface of the rear cover 36*e* being recessed toward the front side, even when the guide duct 53 is positioned over the front side and the upper side of the evaporator 70, the guide duct 53 may be prevented from protruding from the evaporator seating part 36*a* into the storage chamber 310.

The rear cover 36*e* may be provided with a cold air suction port 36*j* at an upper central portion thereof. Cold air distributed in the evaporator seating part 36*a* which is formed by the evaporator 70 may pass through the cold air suction port 36*j* by a suction force formed by the fan 36*i* and then flow to the guide part 36*f* Thereafter, the cold air flowing along a flow path formed in the guide part 36*f* may flow to a first cold air port 36*g* connected to the supply duct 51 and a second cold air port 36*o* connected to the cold air discharge port 36*cb* of the evaporator cover 36*c*.

The guide part 36*f* may be disposed between the evaporator cover 36*c* and the rear cover 36*e*. The guide part 36*f* may have a substantially rectangular parallelepiped shape, and may be provided to be seated on the rear cover 36*e*. The rear cover 36*e* may be coupled to the guide part 36*f* while surrounding the edge of the guide part 36*f* at the rear of the guide part 36*f*.

Hereinafter, a method of manufacturing a refrigerator according to the structure of the first partition 110, the second partition 120, and the inner case 30 will be described.

First, the inner case 30 having the storage chamber 310 formed therein and the opening 33 arranged on the front side of the storage chamber 310 is formed. In this process, the evaporator seating part 36*a* including the evaporator seating opening 36*b* that is open to face the opening 33 may be formed by recessing a portion of the rear wall of the inner case 30 forming the rear surface of the storage chamber 310 toward the rear of the refrigerator 1.

In the next operation, the outer case 20 forming the external appearance of the refrigerator 1 is formed.

In the next operation, the outer case 20 is coupled to the outer side of the inner case 30. In this process, the filling part 40 is provided between the inner case 30 and the outer case 20.

In the next operation, the first partition 110 having the above-described structure formed to extend in the upper-lower direction is formed such that the hollow part 111 formed inside the first partition 110 includes the partition opening 112 that communicates with the filling part 40.

In the next operation, the partition fixing opening 34 provided at a position of the inner case 30 corresponding to the partition opening 112 is formed. The partition fixing opening 34 may be formed through a punching process in the operation of forming the inner case 30.

In the next operation, the both ends 110*e* and 110*f* of the first partition 110 are fixed to the inner case 30 such that the first partition 110 is disposed adjacent to the opening 34 while the partition opening 112 and the partition fixing opening 34 correspond to each other. Specifically, the first partition 110 may be pushed into the storage chamber 310 while the first fixing hook 211 formed on the one end 110*e* of the first partition 110 faces upward of the first partition 110, and the second fixing hook 221 formed on the other end 110*f* of the first partition 110 faces downward of the first partition 110. In this case, the interval between the one end 110*e* of the first partition 110 and the other end 110*f* of the first partition 110 may correspond to the height of the storage chamber 310 formed by the inner case 30. Therefore, in the process of pushing the first partition 110 into the storage chamber, the first fixing hook 211 and the second fixing hook 221 may be caught in the inner case 30. However, since the insulator 41 is in a state not filling the filling part 40, the inner case 30 provided by bending a thin plate shape may be elastically deformed in the upper-lower direction with flexibility.

When the first communication part 210 of the first partition 110 is inserted into the first partition fixing opening 34*a*, and the second communication part 220 is fully inserted into the second partition fixing opening 34*b*, the inner case 30 may return to the original form.

In the next operation, the hot pipe 90 extending from the condenser (not shown) may be buried along a circumference of the opening 33 to include a portion extending in parallel with the first partition 110. Specifically, the hot pipe 90 is buried by fixing the portion of the hot pipe 90, which is formed to extend in parallel with the first partition 110, to the hot pipe seating part 110*c* of the first partition 110.

In the next operation, the partition cover 91 formed to extend in parallel with the first partition 110 such that the portion of the hot pipe 90 extending in parallel with the first partition 110 is not visible from the front of the refrigerator 1 is formed, and coupled to the first partition 110, specifically, to the front surface of the hot pipe seating part 110*c*.

In the next operation, the insulator 41 may be injected into the filling part 40 from a partial area of the filling part 40 communicating with the outside of the refrigerator 1. In this process, the insulator 41 may sequentially pass through the filling part 40, the first partition fixing opening 34*a*, and the first partition opening 112*a* to finally fill the hollow part 111. Alternatively, depending on a position in the filling part 40 in which the insulator 41 is initially injected, the insulator 41 may sequentially pass through the hollow part 111, the first partition fixing opening 34*a*, and the first partition opening 112*a* to finally fill the filling part 40. That is, the insulator 41 may flow in the upper-lower direction along an extension direction D3 of the first communication part 210 (see FIG. 11).

The insulator 41 may sequentially pass through the filling part 40, the second partition fixing opening 34*b*, and the second partition opening 112*b* to finally fill the hollow part 111. Alternatively, depending on a position in the filling part 40 in which the insulator 41 is initially injected, the insulator 41 may sequentially pass through the hollow part 11, the second partition fixing opening 34*b*, and the second partition opening 112*b* to finally fill the filling part 40. That is, the insulator 41 may flow in the upper-lower direction along an extension direction D4 of the second communication part 220 (see FIG. 12).

When sufficient time has elapsed after the insulator 41 is foamed, the insulator 41 may uniformly fill the filling part 40 and the hollow part 111 and hardened, and in this case, the insulator 41 may be hardened in a state of being fitted through the partition fixing opening 34 and the partition opening 112.

Therefore, in addition to the fixing structure provided at the both ends of the first partition 110, the insulator 41 hardened while fitted through the partition fixing opening 34 and the partition opening 112 may allow the first partition 110 to be firmly fixed to the inner case 30.

In the next operation, the evaporator 70 formed to extend in the left-right direction to correspond to the width in the left-right direction of the evaporator seating part 36*a* is seated on the evaporator seating part 36*a*, and the evaporator cover 36*c* provided in a shape corresponding to the evaporator seating opening 36*b* and configured to cover the evaporator seating part 36*a* is fixed to the circumference of the evaporator seating opening 36*b*.

In the next operation, the second partition 120 provided in the above-described structure is formed and coupled to the first partition 110 from the rear of the first partition 110 to form the partitioning parts, so that the storage chamber 310 is divided into a plurality of storage chambers. Specifically, the second partition support part 124 formed to protrude toward the evaporator cover 36*c* is formed on the second partition 120, and the second partition mounting part 36*d* is formed in the evaporator cover 36*c* at a position corresponding to the second partition support part 124, and the second partition seating part 36*d* is formed to keep the second partition 120 in position while surrounding at least a portion of the second partition support part 124.

The above-described series of processes may allow a refrigerator to be manufactured such that the evaporator 70 inside the storage chamber 310 is easily repaired by only withdrawing the second partition 120 from the storage chamber 310 without needing to separate the first partition 110 from the storage chamber 310. In addition, the refrigerator is manufactured such that damage to the hot pipe 90 formed along the first partition 110 is minimized since there is no need to separate the first partition 110 from the storage compartment 310.

A refrigerator according to an aspect of the disclosure can facilitate repair of an evaporator inside a storage chamber by withdrawing only a second partition from the storage chamber without needing to separate a first partition from the storage chamber through the structure of the first partition, the second partition, and the inner case.

Moreover, a refrigerator according to an aspect of the disclosure can facilitate repair of the evaporator without damage to a hot pipe during a disassembly process of the second partition.

A method of manufacturing a refrigerator according to another aspect of the disclosure can omit a process of separately filling the partition with an insulator.

Although the refrigerator and the method of manufacturing the same have been described with reference to accompanying drawings based on specific shapes and directions, it would be appreciated by those skilled in the art that changes and modifications may be made in the disclosure without departing from the principles and scope of the disclosure, the scope of which is defined in the claims and their equivalents.

DESCRIPTION OF REFERENCE NUMERALS

1; refrigerator
10; main body
20; outer case
30; inner case
33; opening
34; partition fixing opening
36*c*: evaporator cover
40; filling part
41; insulator
70; evaporator
90; hot pipe
91; partition cover
110; first partition
111; hollow part
120; second partition
310; storage chamber
312; lower storage chamber
312*a*, 312*b*; right storage chamber, left storage chamber

What is claimed is:

1. A refrigerator comprising:

an inner case forming a storage chamber, an intermediate partition partitioning the storage chamber in an upper-lower direction, and an evaporator seating part extending in a left-right direction to corresponding to a width in the left-right direction of the storage chamber is;

an outer case coupled to an outer side of the inner case to form an external appearance of the refrigerator;

an evaporator cover configured to cover the evaporator seating part and formed with a cold air discharge port through which cold air from inside the evaporator seating part is dischargeable to the storage chamber;

a first partition fixed to the intermediate partition and a bottom surface of the inner case, the first partition including a partition opening that communicates with a space between the inner case and the outer case;

a partition fixing opening formed in the inner case or the intermediate partition, the partition fixing opening provided at a position corresponding to the partition opening to allow an insulator to pass through the partition opening and the partition fixing opening; and a second partition coupleable to the first partition so that, while coupled to the first partition, the second partition is inside the storage chamber supported by at least a portion of the inner case or the evaporator cover and arranged behind the first partition to form a partitioning part together with the first partition to thereby divide the storage chamber in the left-right direction, and being decoupleable from the first partition to thereby be removable from the storage compartment.

2. The refrigerator of claim 1, further comprising:

a condenser; and a hot pipe extending from the condenser, wherein the hot pipe is buried along a circumference of an opening of the storage chamber and has a portion extending in parallel with the first partition.

3. The refrigerator of claim 2, further comprising:

a partition cover extending in parallel with the first partition and coupled to the first partition while covering the portion of the hot pipe extending in parallel with the first partition so that the portion of the hot pipe extending in parallel with the first partition is not seen at a front of the refrigerator.

4. The refrigerator of claim 3, wherein the first partition includes:

left first partition, a right first partition coupled to a right side of the left first partition, and a hot pipe seating part seating the hot pipe in an area between the left first partition and the right first partition and spacing the left first partition from the right first partition, and the partition cover is coupled to a front surface of the hot pipe seating part.

5. The refrigerator of claim 4, wherein the first partition includes a first coupling part protruding from a surface of the first partition and having a first fastening hole, the second partition includes a second coupling part protruding from a surface of the second partition and having a second fastening hole, and the refrigerator further comprising a fastening member configured to simultaneously pass through the first fastening hole and the second fastening hole to couple the first partition and the second partition to each other.

6. The refrigerator of claim 5, wherein the first coupling part further includes support parts configured to support ends of the second coupling part in an upper-lower direction.

7. The refrigerator of claim 5, wherein the first coupling part or the support parts is formed on one of the right first partition and the left first partition.

8. The refrigerator of claim 1, wherein the inner case includes a rear wall forming a rear surface of the storage chamber while facing an opening of the storage chamber, the evaporator seating part is provided by a portion of the rear wall being recessed rearward, and the evaporator seating part includes an evaporator seating opening that is opened to face the opening.

9. The refrigerator of claim 8, wherein the evaporator cover has a shape corresponding to a shape of the evaporator seating opening.

10. The refrigerator of claim 9, wherein the second partition includes a second partition support part that protrudes toward the evaporator cover while the second partition is coupled to the first partition, the evaporator cover includes a second partition seating part formed at a position corresponding to the second partition support part, and the second partition seating part is provided to keep the second partition in position while surrounding at least a portion of the second partition support part.

11. The refrigerator of claim 1, wherein the second partition includes a left partition, and a right partition coupled to a right side of the left partition, and a space formed between the left partition and the right partition is provided as an empty space.

12. The refrigerator of claim 1, wherein the partitioning part partitions the storage chamber into a left storage chamber and a right storage chamber, and the partitioning part is provided such that cold air flows from the left storage chamber to the right storage chamber or from the right storage chamber to the left storage chamber.

13. The refrigerator of claim 1, further comprising:

a filling part between the inner case and the outer case, wherein the partition opening includes a first partition opening and a second partition opening formed at respective ends of the first partition such that a hollow part formed inside the first partition communicates with the filling part, the partition fixing opening includes a first partition fixing opening provided at a position corresponding to the first partition opening and a second partition fixing opening provided at a position corresponding to the second partition opening, and the insulator fills the filling part and the hollow part by passing through the first partition opening and the first partition fixing opening or passing through the second partition opening and the second partition fixing opening.

14. The refrigerator of claim 13, wherein the first partition further includes a communication part connecting the partition opening to the partition fixing opening, the communication part protruding from the first partition while surrounding the partition opening and having a side surface supported by an inner surface of the partition fixing opening.

15. The refrigerator of claim 14, wherein the communication part includes a first communication part corresponding to the first partition opening and a second communication part corresponding to the second partition opening, and the first communication part includes a first fixing hook extending from one end of the first communication part to enable elastic deformation, the first fixing hook supported on a surface of the inner case facing the filling part and located at a circumference of the first partition fixing opening, and the second communication part includes a second fixing hook extending from one end of the second communication part, the second fixing hook supported on a surface of the inner case facing the filling part and located at a circumference of the second partition fixing opening.

16. The refrigerator of claim 1, wherein the intermediate partition is formed as a portion of the inner case that is bent.

* * * * *